US008474814B2

(12) United States Patent
Noda et al.

(10) Patent No.: US 8,474,814 B2
(45) Date of Patent: Jul. 2, 2013

(54) SHEET SUPPLYING UNIT AND SHEET WIDTH DETECTING UNIT

(75) Inventors: Yasuo Noda, Fukushima (JP); Hiroaki Ono, Fukushima (JP); Toru Koike, Fukushima (JP)

(73) Assignee: Oki Data Corporation, Tokyo (JP)

( * ) Notice: Subject to any disclaimer, the term of this patent is extended or adjusted under 35 U.S.C. 154(b) by 726 days.

(21) Appl. No.: 11/504,577

(22) Filed: Aug. 16, 2006

(65) Prior Publication Data

US 2007/0040326 A1 Feb. 22, 2007

(30) Foreign Application Priority Data

Aug. 19, 2005 (JP) ..... 2005-238859

(51) Int. Cl.
*B65H 7/02* (2006.01)

(52) U.S. Cl.
USPC ..... 271/227; 347/104

(58) Field of Classification Search
USPC ..... 271/227, 228; 347/104, 16; 101/486, 101/485
See application file for complete search history.

(56) References Cited

U.S. PATENT DOCUMENTS 6,318,714 B1 * 11/2001 Beskitt et al. ..... 271/10.01
6,888,650 B1 * 5/2005 Mizubata et al. ..... 358/488
2002/0011431 A1 * 1/2002 Graef et al. ..... 209/534
2004/0094891 A1 * 5/2004 Trovinger et al. ..... 271/227
2004/0223022 A1 * 11/2004 Endo ..... 347/19
2005/0270323 A1 * 12/2005 Oshio et al. ..... 347/14

FOREIGN PATENT DOCUMENTS

JP 59-57429 4/1984
JP 04368877 A * 12/1992
JP 11-116100 4/1999
JP 2002-193492 7/2002
JP 2002-347297 12/2002
JP 2002-347995 12/2002
JP 2005096991 A * 4/2005

* cited by examiner

*Primary Examiner* — Kaitlin Joerger
*Assistant Examiner* — Ernesto Suarez
(74) *Attorney, Agent, or Firm* — Rabin & Berdo, P.C.

(57) ABSTRACT

A sheet supplying unit having no need to place a great many skew sensors and enabling printing apparatus to simplify structure and to reduce cost. The sheet supplying unit moves a skew sensor to a most left sensor position in which the table sensor detected that the print medium exists, detects the upper edge of print medium, and executes a skew detection; in the case that the print medium is narrow, moves a skew sensor, detects the upper edge of print medium, and executes a skew detection; in the case that a position of skew sensor does not place at a position keeping a predetermined margin at the inside of the print medium, moves skew sensor to the inside of the print medium and executes again an inclination detection; or according to print medium width and skew sensor width, changes a skew judgment quantity.

8 Claims, 23 Drawing Sheets

THERE IS A SENSOR AT THE OUTSIDE OF MOST RIGHT EDGE SENSOR POSITION (E POINT) (EXAMPLE 1)

THERE IS A SENSOR AT THE OUTSIDE OF MOST RIGHT EDGE SENSOR POSITION (E POINT) (EXAMPLE 2)

THERE IS NO SENSOR AT THE OUTSIDE OF MOST RIGHT EDGE SENSOR POSITION (E POINT)

IN THE CASE TO DETECT PRINT MEDIUM BY ONE TABLE SENSOR (SKEW DETECTION IS IMPOSSIBLE)

IN THE CASE TO DETECT PRINT MEDIUM BY TWO TABLE SENSORS (SKEW DETECTION IS IMPOSSIBLE)

IN THE CASE TO DETECT PRINT MEDIUM BY THREE TABLE SENSORS

| SENSOR NUMBER | PRINT MEDIUM KIND | SKEW JUDGMENT STANDARD VALUE | NOTE |
|---|---|---|---|
| ONE | VERTICAL POSTCARD | 10/360 INCH + MARGIN | H1 POINT |
| THREE | HORIZONTAL POSTCARD | 7/360 INCH MARGIN | H2 POINT |
| FIVE | HORIZONTAL A4 SHEET | 3/360 INCH MARGIN | H4 POINT |

PRIOR ART

PRIOR ART

SHEET SUPPLYING UNIT AND SHEET WIDTH DETECTING UNIT

BACKGROUND OF THE INVENTION

1. Field of the Invention

The invention relates to a sheet supplying technique in printing apparatus which moves print head and executes a print, such as serial dot printer, an ink jet printer and the like.

2. Related Background Art

In conventional printing apparatus, as shown by FIGS. 20 and 21, a sheet supplying unit is furnished for supplying print medium 13 (at left side in FIG. 20) such as sheet to printing section P1. When the print medium 13 supplied to the printing section P1 by the sheet supplying unit skews, and arrives at the printing section P1 in the skewing state, a skewing print will be caused. Therefore, in order to prevent the print from skewing, a plurality of slip rollers 11 for rectifying such skew are arranged rotating-freely.

Further, in the conventional printing apparatus, in order to detect the skew, as shown by FIG. 21, under table 16 at the upstream side of feed roller 12 along a conveyance direction, a plurality of table sensors 14 are arranged; under table 16 at the downstream side of feed roller 12 along a conveyance direction, a plurality of skew sensors 15 are arranged.

Then, in the conventional printing apparatus, as shown by FIG. 21, after operator puts the print medium 13 onto the table 16 so as to make the print medium 13 covers at least one of plural roller substance section 11*b* to construct the slip roller 11, through the table sensor 14 detected that the print medium 13 has been put, a skew rectifying motor (not shown in figure) is driven, the slip roller 11 is rotated and the print medium 13 is conveyed.

With the conveyance of the print medium 13, the front edge (that is, in FIG. 21, it is upper edge of the sheet) of the print medium 13 touches with a contact point of a predetermined roller substance section 12*b*' in respective roller substance section 12*b* to construct the feed roller 12.

At that time, because the roller substance sections 11*b* and the roller substance sections 12*b* are respectively arranged in corresponding positions each other, while the front edge of the print medium 13 touches with a contact point of a predetermined roller substance section 12*b*', the roller substance section 11*b*' being in the roller substance sections 11*b* and corresponding to the predetermined roller substance section 12*b*' is made to slip with respect to the print medium 13, the conveyance of print medium 13 through the roller substance section 11*b*' is not executed.

Because the other roller substance sections 11*b* continue to execute the conveyance of the print medium 13, the front edge of the print medium 13 sequentially touch with respective contact points of each of roller substance sections 12*b*, then the respective roller substance sections 11*b* corresponding to the respective roller substance sections 12*b* are respectively made to slip with respect to the print medium 13, the conveyance of the print medium 13 through the respective roller substance sections 11*b* are not executed. That is, the print medium 13 is rotated to the position of print medium 13' along a direction A in FIG. 21.

Thus, the skew which occurred when putting the print medium 13 is rectified. Moreover, the roller substance section 11*b* is made from soft rubber material so as to possibly sufficiently slip with respect to the print medium 13.

Then, after the slip roller 11 only rotated a predetermined quantity, through driving a line feed motor, the feed roller 12 is rotated and the print medium 13 is conveyed to the printing section P1.

Further, after the front edge of the print medium 13 arrived at the skew sensors 15 while conveying the print medium 13, the skew sensors 15 detects a detection difference of left and right of the print medium 13. If the detection difference exceeds a threshold value, it is judged that the skew is not rectified, the line feed motor is driven to rotate along a contrary direction, and the print medium 13 is discharged.

Then, if the detection difference is under the threshold value, it is judged that the skew has been rectified, the line feed motor continues to be driven. As a result, the feed roller 12 is executed to rotate along a supplying-sheet direction, the print medium 13 is supplied to the printing section P1, and a print is executed in the printing section P1. (for example, it may refer to patent document 1)

Patent document 1: Japanese patent publication 2002-193492.

However, in the sheet supplying unit of the conventional printing apparatus, it is necessary to arrange a great many skew sensors 15 along the print medium width direction, the structure of the printing apparatus becomes complex, and the cost of the printing apparatus becomes high.

SUMMARY OF THE INVENTION

It is, therefore, an object of the invention to provide a printing apparatus capable of solving the above stated problem.

According to the present invention, there is provided a sheet supplying unit, comprising:

a plurality of first detecting sections which are arranged in a spaced relation in a direction substantially perpendicular to a sheet conveyance direction, and detects a sheet supplied to a sheet conveyance surface;

a skew rectifying section which rectifies a skew of the sheet on the basis of a detection result of the first detecting section;

a moving body which is placed at a downstream side of the sheet conveyance direction and is movable;

a pair of second detecting sections which are placed on the moving body in a direction substantially perpendicular to the sheet conveyance direction according to an interval and detects that the sheet passed; and a moving body position deciding section which decides a moving body position while skew detection on the basis of a detection position of sheet existence of the first detecting section.

Moreover, in the sheet supplying unit, the moving body is moved so as to make left the second detecting section place at a most left edge position in which the first detecting section detected that the sheet exists, or to make right the second detecting section place at a most right edge position in which the first detecting section detected that the sheet exists.

Moreover, the sheet supplying unit may further comprise a sheet width detecting section which moves the moving body based on the detection position of sheet existence of the first detecting section and detects a sheet width through the second detecting section, wherein on the basis of a sheet width detection result of the sheet width detecting section, a moving body position operation range is decided.

Moreover, in the sheet supplying unit, on the basis of the sheet width detection result of the sheet width detecting section, it is judged whether a skew can be detected, when the skew can not be detected without moving the moving body, the moving body is moved, and a skew detection is executed.

Moreover, in the sheet supplying unit, on the basis of the number of the first detecting section which detected that the sheet exists, it is judged whether a skew can be detected without moving the moving body.

Moreover, in the sheet supplying unit, when a position of the second detecting section while skew detection does not place at that keeping a predetermined margin at the inside of the sheet, after moved the second detecting section to the inside of the sheet, the skew detection is again executed.

Moreover, in the sheet supplying unit, a skew judgment threshold value is provided which is set on the basis of the sheet width detection result of the sheet width detecting section, based on the skew judgment threshold value, a skew judgment is executed. In the case, the skew judgment threshold value may be decided on the basis of the number of the first detecting section which detected that the sheet exists.

Moreover, in the sheet supplying unit, the moving body carries a machinery to execute print on the sheet.

Further, according to the present invention, there is provided a sheet width detecting unit, comprising:

a moving body which is placed along a sheet conveyance direction and is movable; and a pair of detecting sections which are placed in a spaced relation on the moving body along a direction substantially perpendicular to the sheet conveyance direction and detects that the sheet passed, wherein on the basis of a detection result of the detecting section, a width of the sheet is detected.

Moreover, in the sheet width detecting unit, the moving body carries a machinery to execute print on the sheet.

According to the printing apparatus of the present invention, because it is possible to keep a predetermined margin to make skew sensor move to the inside of most left end sensor position in which table sensor detected the print medium exists and to certainly detect skew, it is unnecessary to arrange a great many skew sensors, and the apparatus cost can be reduced together with the skew can be certainly detected.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Moreover, with respect to the common element in drawings, the same symbol is added. Further, in the following explanation, a general serial dot printer is explained, the explanation may also be applied to an ink jet printer and the like.

Embodiment 1

The printing apparatus of embodiment 1 executed to move skew sensor to the inside of most left-end sensor position in which table sensor detected the print medium exists, to detect upper edge of print medium, and to detect skew.

(Structure)

Figure 1:
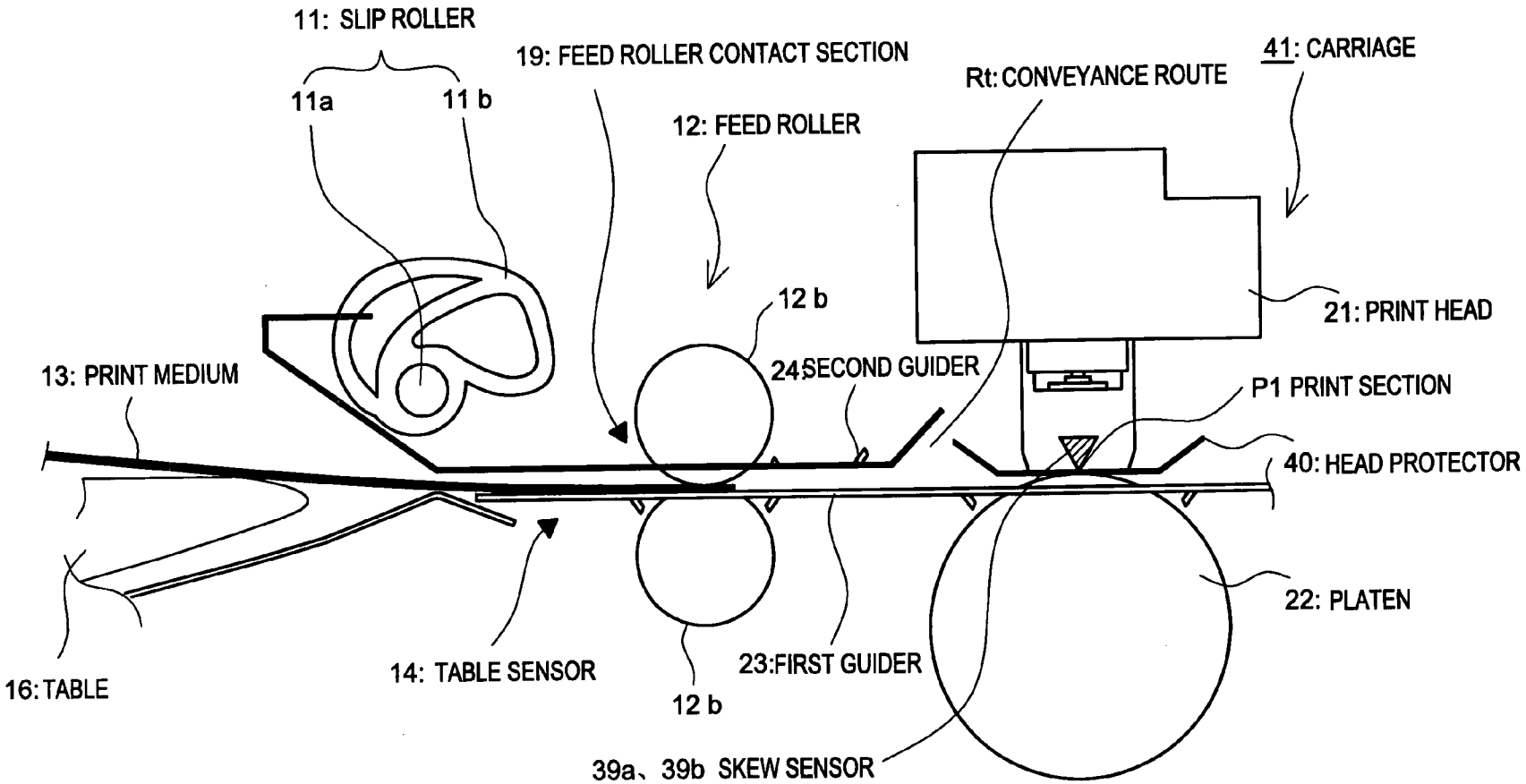
FIG. 1 is a summary structure diagram showing a printing apparatus in embodiment 1.
Figure 2:
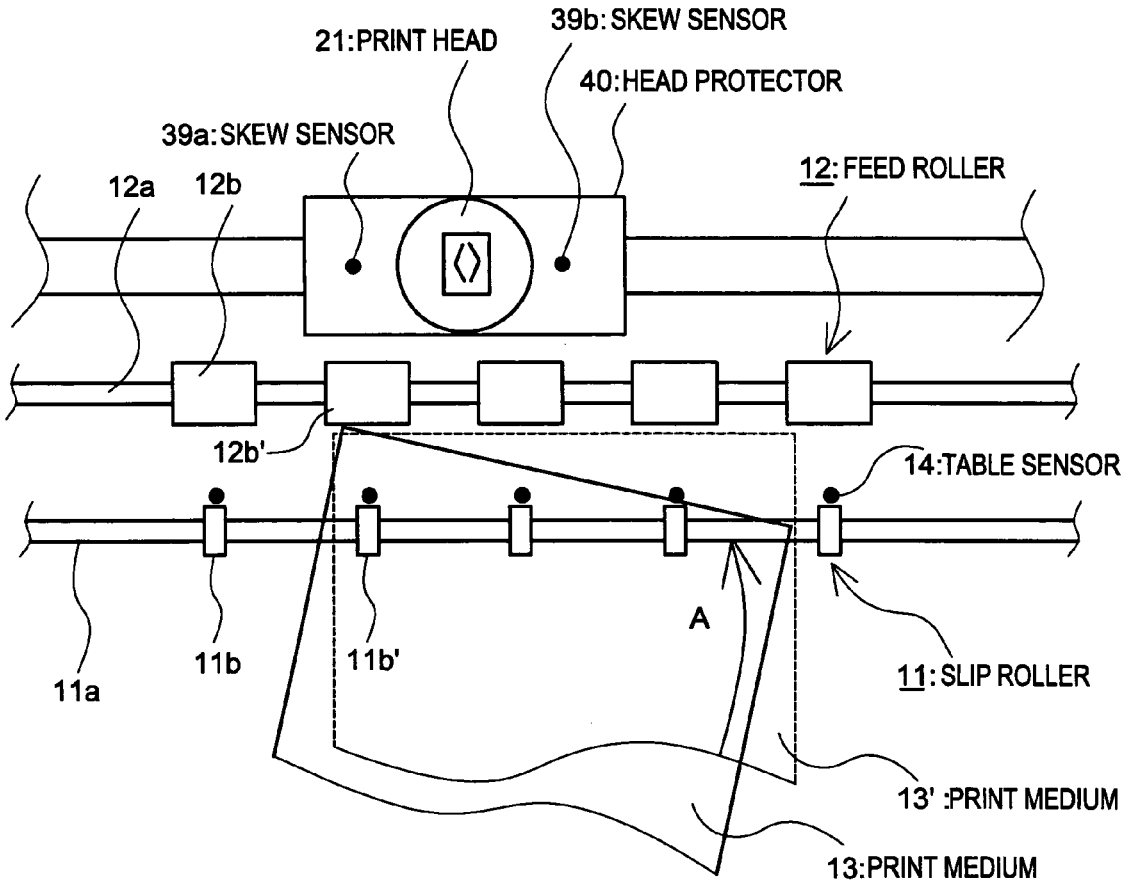
FIG. 2 is an operation explanation diagram of a printing apparatus in embodiment 1.

FIG. 1 is a summary structure diagram showing a printing apparatus in embodiment 1; and FIG. 2 is an operation explanation diagram of a printing apparatus in embodiment 1.

As shown by FIG. 1, in the printing apparatus of the embodiment 1, a print head 21; a platen 22 which is placed rotating-freely to face the print head 21; a printing section P1 placed between the print head 21 and platen 22 are formed.

Further, in the printing apparatus, a first guider 23 to guide the print medium 13; a second guider 24 placed by keeping a predetermined interval with the first guider 23 and used for guiding the print medium 13; a conveyance route Rt for conveying the print medium 13 toward the printing section P1 between the first guider 23 and the second guider 24 are formed.

Further, at the upstream side of the printing section P1 along a conveyance direction of the print medium 13, feed roller 12 made up of a pair of rollers are arranged rotating-freely. Through making the feed roller 12 rotate, the print medium 13 is conveyed. The feed roller 12 is formed from a shaft section 12*a* and roller substance sections 12*b* arranged at plural places along an axis direction of the shaft section 12*a*.

Furthermore, under the table 16 placed at the upstream side of the feed roller 12 along the conveyance direction of the print medium 13, table sensor 14 is provided; and on a head protector 40 of the printing section P1 placed at the downstream side of the feed roller 12 along the conveyance direction of the print medium 13, skew sensors 39*a* and 39*b* are provided. The table sensor 14, as shown by FIG. 2, is plurally arranged along a print medium width direction, and the skew sensor 39*a* and the skew sensor 39*b* are arranged in pairs along a left and right direction of the printing section P1.

Moreover, not only a pair of the skew sensor 39*a* and the skew sensor 39*b* may be arranged, but also a great many skew sensors may be arranged for improve detection precision. Further, the skew sensors 39*a* and 39*b* may be reflection type optical sensor, also may be penetrating type sensor with a complex structure. Hereinafter, to combining the print head 21 and the head protector 40 to serving as a body, a carriage 41 is called.

Furthermore, at the upstream side of the feed roller 12 and the table sensor 14 along the conveyance direction of the print medium 13, toward the side of the second guider 24, a slip roller 11 is placed rotating-freely. The slip roller 11 is formed from a shaft section 11*a* and roller substance sections 11*b* arranged at plural places along an axis direction of the shaft section 11*a*. Moreover, the roller substance section 11*b* is made from soft rubber material so as to possibly sufficiently slip with respect to the print medium 13.

(Whole Function Block)

Figure 3:
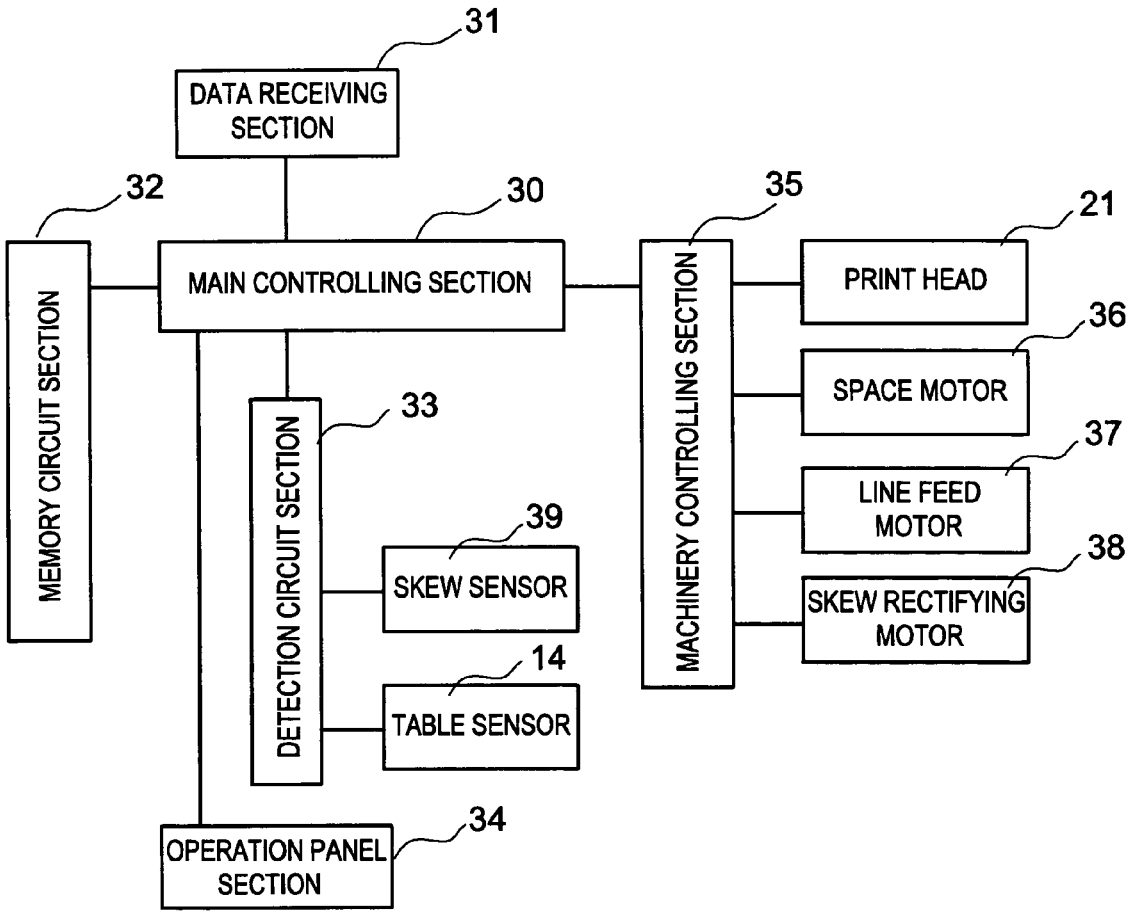
FIG. 3 is block diagram showing a whole of a printing apparatus in embodiment 1.

FIG. 3 is block diagram showing a whole of a printing apparatus in embodiment 1. as shown by FIG. 3, on a main controlling section 30 serving as a controlling means, a machinery controlling section 35, a detection circuit section 33, a memory circuit section 32, a data receiving section 31, an operation panel section 34 are connected. Then, on the detection circuit section 33, the skew sensor 39, the table sensor 14 are connected; on the machinery controlling section 35, the print head 21, a space motor 36, a line feed motor 37, a skew rectifying motor 38 are connected.

Here, the main controlling section 30 is to receive control data, print data and control signal from a host apparatus via the data receiving section 31, and to execute an analysis or an expansion for image buffer with respect to the received control data, print data and control signal.

The machinery controlling section 35, for example, in the case that the printing apparatus is a serial dot printer, has plurality of dot pins, and is to control the space motor 36 which makes the print head 21 move along width direction of the print medium 13, and to control the line feed motor 37 which makes the print head 21 execute line feed (i.e. change-line) movement.

Further, the detection circuit section 33 is to receive detection signals output from the skew sensor 39 for detecting the front edge position of the supplied print medium 13 and from the table sensor 14 for detecting the print medium 13 put on the table 16.

Here, the skew sensor 39 detects the width of the supplied print medium 13, that is, print medium width, and is used as a print medium width sensor for control the position on width direction of the print medium 13. The table sensor 14 is also used to detect the lower edge position of the supplied print medium 13.

Then, the memory circuit section 32 has a buffer memory for memorizing print data sent from the main controlling section 30 or for expanding the print data to be print into image buffer, further has a memory for memorizing data such as print medium width, print medium length or the like of the print medium 13 detected in the detection circuit section 33.

Furthermore, the memory circuit section 32 has a non-volatility memory for memorizing setup mode selected in the operation panel section 34. The operation panel section 34 is made from LCD display panel or LED lamp, and displays operation key (not shown in drawings) and operation situation for setting up operation mode information and the like.

(Firmware Function Block)

Figure 4:
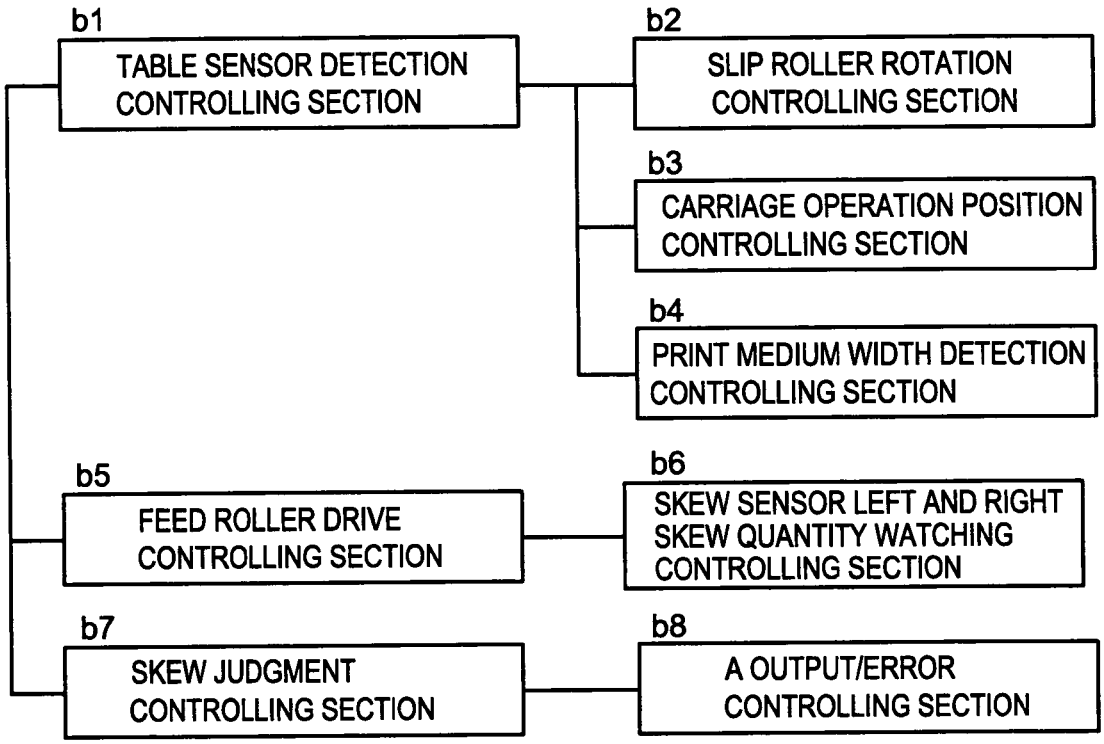
FIG. 4 is a firmware block diagram showing a printing apparatus in embodiment 1.

FIG. 4 is a firmware block diagram showing a printing apparatus in embodiment 1. As shown by FIG. 4, the function block is formed from a table sensor detection controlling section b1 for identifying the set print medium 13; a feed roller drive controlling section b5 for conveying the print medium 13; and a skew judgment controlling section b7 for judging a difference of feed quantity from the upper edge of the print medium 13.

Then, the table sensor detection controlling section b1 is connected with a slip roller rotation controlling section b2 for driving slip roller; with a carriage operation position controlling section b3 for making carriage operation execute according to the number of table sensors capable of identifying that the print medium 13 exists; and with a print medium width detection controlling section b4 for deciding operation range according to the position of table sensors capable of identifying that the print medium 13 exists.

Further, on the feed roller drive controlling section b5, a skew sensor left and right skew quantity watching controlling section b6 is connected for watching feed quantity from the upper edge of the print medium 13 through skew sensor of left and right; on the skew judgment controlling section b7, a output/error controlling section b8 is connected for executing a control of output/error when there is skew according to a skew judgment result of the skew judgment controlling section b7.

(Operation)

According to the above structure, the printing apparatus of the embodiment 1 performs the following operations.

Figure 5:
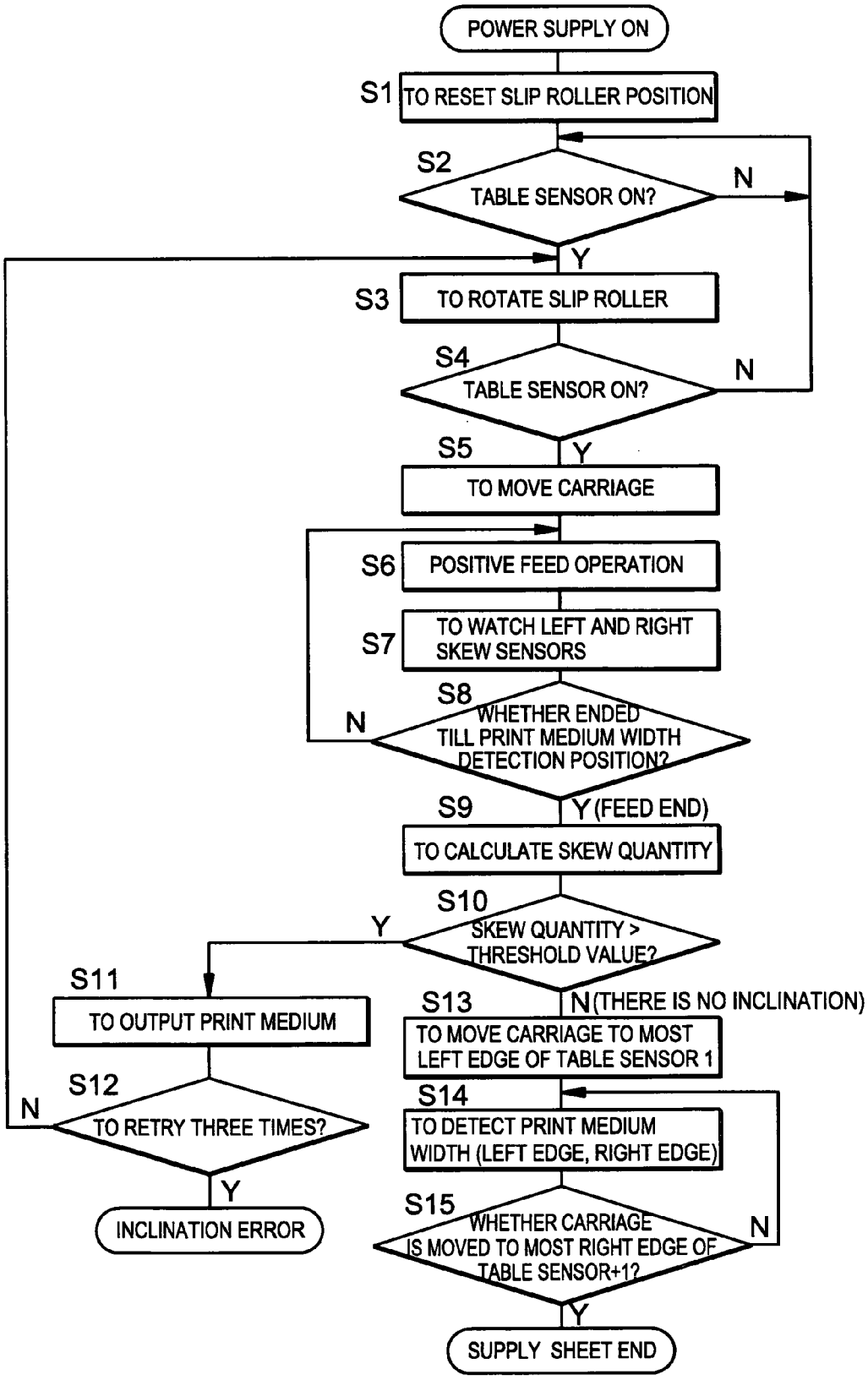
FIG. 5 is a control flowchart of a printing apparatus in embodiment 1.
Figure 6:
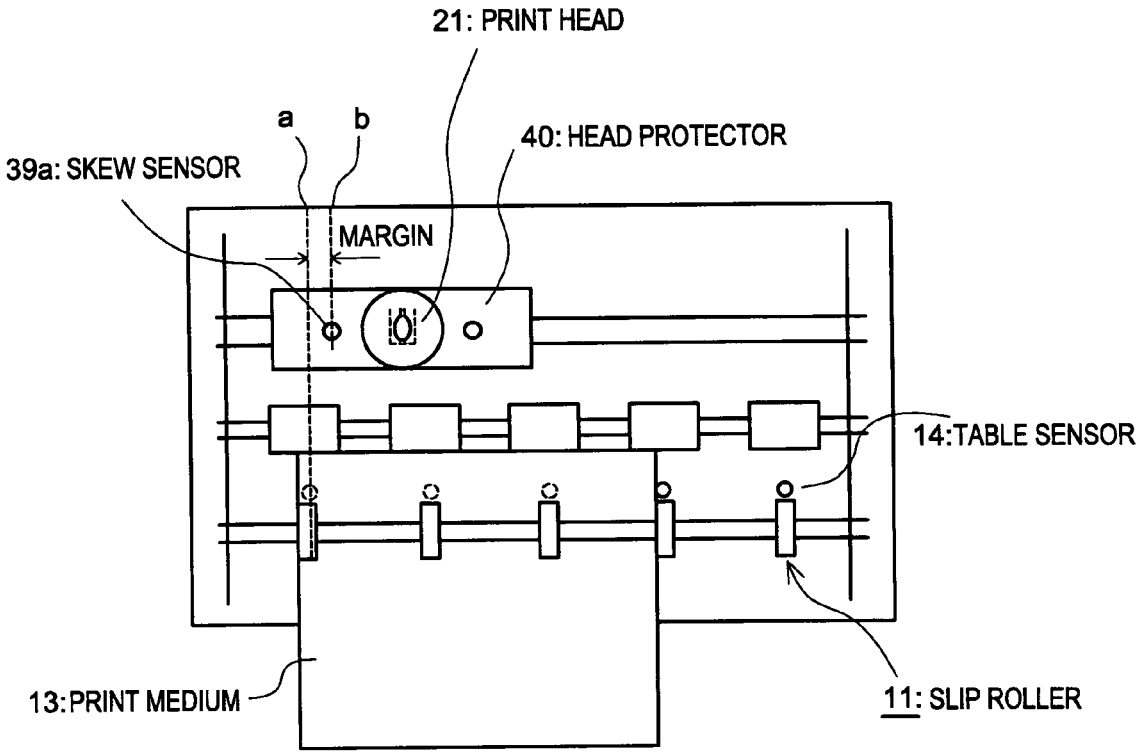
FIG. 6 is an explanation diagram of carriage position before sheet supply of a printing apparatus in embodiment 1.
Figure 7A:
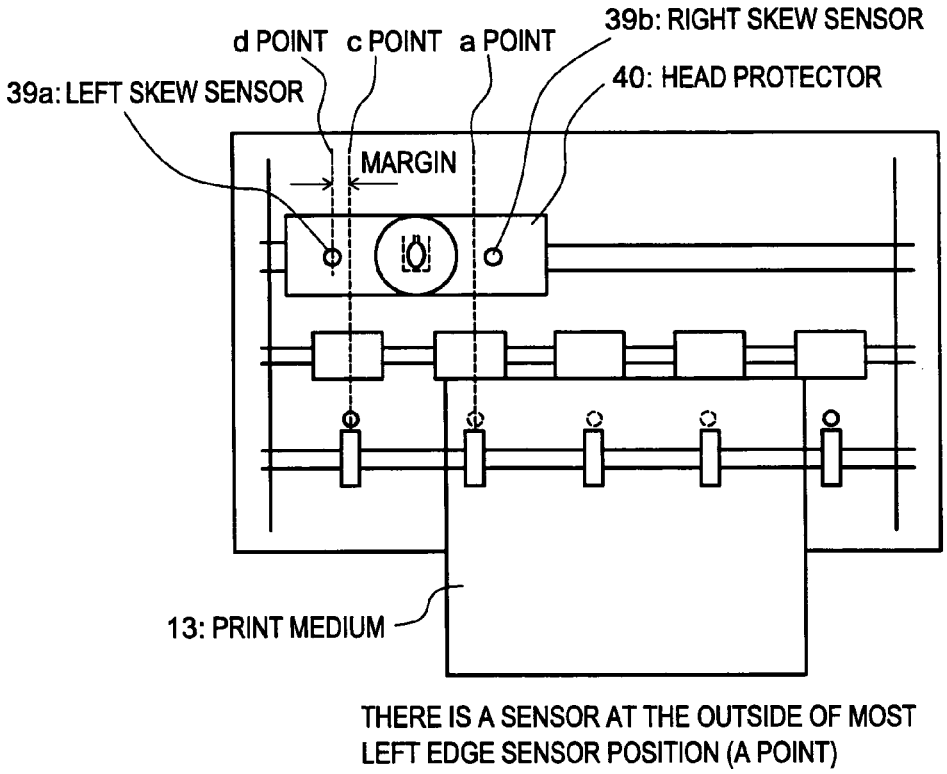
FIG. 7A is a first explanation diagram of carriage position before print medium width detection operation of embodiment 1.
Figure 7B:
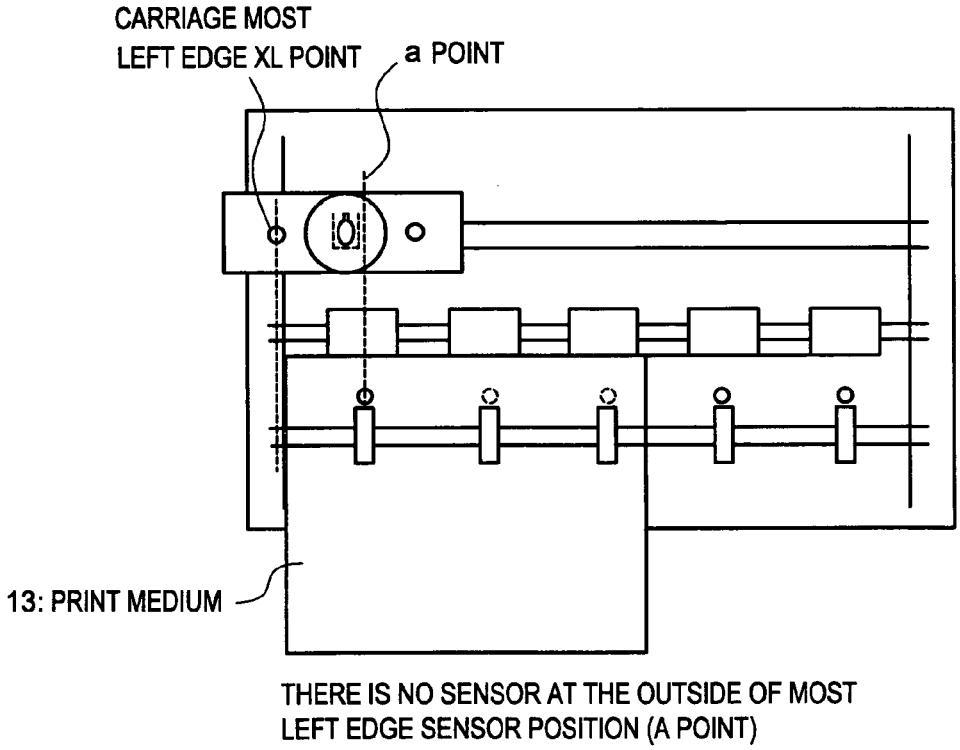
FIG. 7B is a second explanation diagram of carriage position before print medium width detection operation of embodiment 1.
Figure 8A:
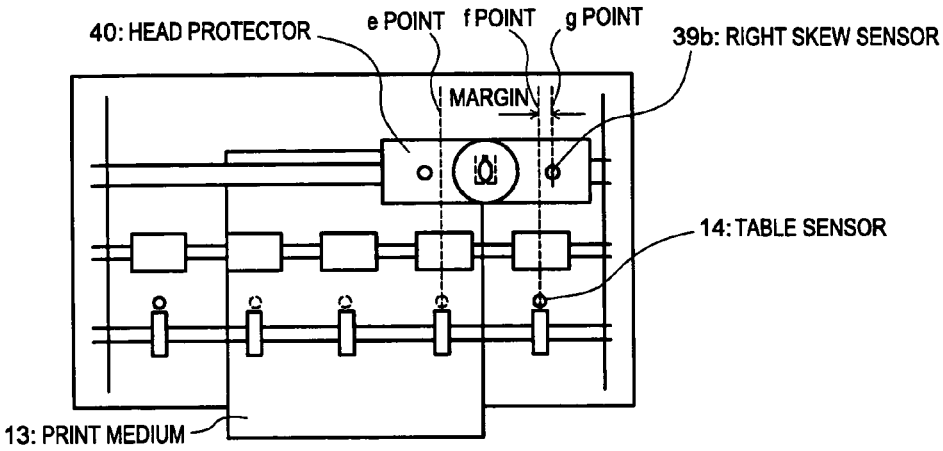
FIG. 8A is a first explanation diagram of carriage position after print medium width detection operation of embodiment 1.
Figure 8B:
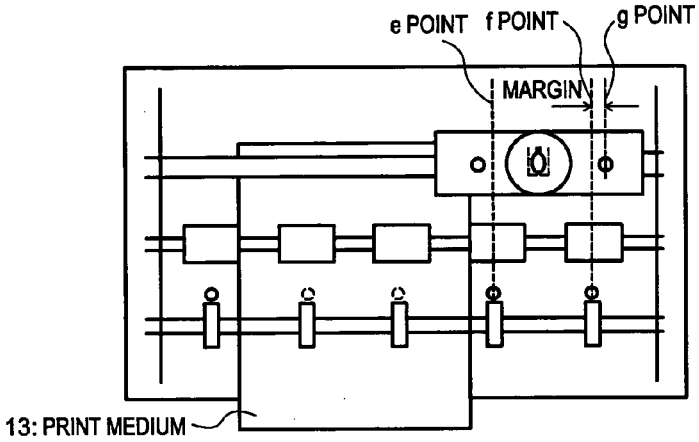
FIG. 8B is a second explanation diagram of carriage position after print medium width detection operation of embodiment 1.
Figure 8C:
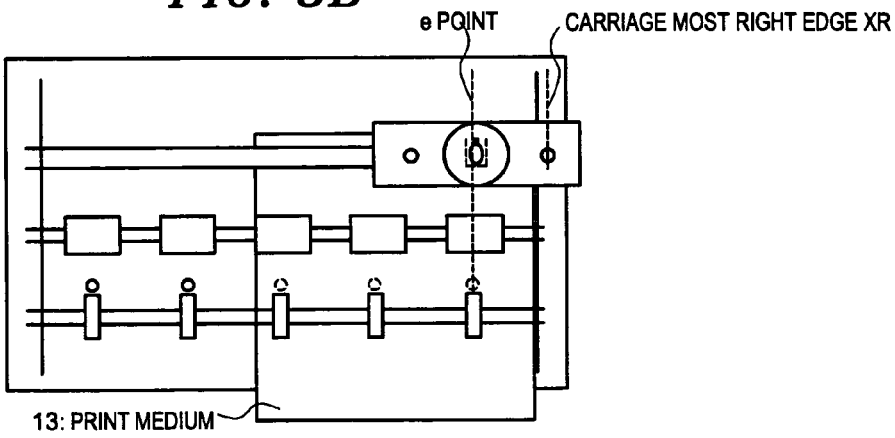
FIG. 8C is a third explanation diagram of carriage position after print medium width detection operation of embodiment 1.

FIG. 5 is a control flowchart of a printing apparatus in embodiment 1; FIG. 6 is an explanation diagram of carriage position before sheet supply of a printing apparatus in embodiment 1; FIG. 7A is a first explanation diagram of carriage position before print medium width detection operation of embodiment 1; FIG. 7B is a second explanation diagram of carriage position before print medium width detection operation of embodiment 1; FIG. 8A is a first explanation diagram of carriage position after print medium width detection operation of embodiment 1; FIG. 8B is a second explanation diagram of carriage position after print medium width detection operation of embodiment 1; and FIG. 8C is a third explanation diagram of carriage position after print medium width detection operation of embodiment 1.

(Explanation of Summary Operation)

Firstly, to explain whole summary operation in print medium conveyance and print by using FIG. 2.

After operator puts the print medium 13 onto the table 16 so as to make the print medium 13 covers at least one of plural roller substance section 11*b* to construct the slip roller 11, through the table sensor 14 detected that the print medium 13 has been put, a skew rectifying motor (not shown in figure) is driven, the slip roller 11 is rotated and the print medium 13 is conveyed.

With the conveyance of the print medium 13, the front edge (that is, in FIG. 2, it is upper edge of the sheet) of the print medium 13 touches with a contact point of a predetermined roller substance section 12*b*' in respective roller substance section 12*b* to construct the feed roller 12.

At that time, because the roller substance sections 11*b* and the roller substance sections 12*b* are respectively arranged in corresponding positions each other, while the front edge of the print medium 13 touches with a contact point of a predetermined roller substance section 12*b*', the roller substance section 11*b*' being in the roller substance sections 11*b* and corresponding to the predetermined roller substance section 12*b*' is made to slip with respect to the print medium 13, the conveyance of print medium 13 through the roller substance section 11*b*' is not executed.

Because the other roller substance sections 11*b* continue to execute the conveyance of the print medium 13, the front edge of the print medium 13 sequentially touch with respective contact points of each of roller substance sections 12*b*, then the respective roller substance sections 11*b* corresponding to the respective roller substance sections 12*b* are respectively made to slip with respect to the print medium 13, the conveyance of the print medium 13 through the respective roller substance sections 11*b* are not executed. Thus, the skew which occurred when putting the print medium 13 is rectified.

Then, after the slip roller 11 only rotated a predetermined quantity, the controlling section sends a drive signal to a line feed motor (not shown) to drive the line feed motor.

Then, after the front edge of the print medium 13 arrived at the skew sensors 39*a* and 39*b* while conveying the print medium 13, the skew sensors 39*a* and 39*b* detect a detection difference of the upper edge of the print medium 13, and send the detection difference signals to the controlling section.

Then, the controlling section reads the detection difference signals, and judges if the detection difference exceeds a threshold value. If the detection difference exceeds the threshold value, the controlling section judges that the skew is not rectified; drives the line feed motor to rotate along a contrary direction; makes the feed roller 12 to rotate along a contrary direction; and outputs the print medium 13.

If the detection difference is less than the threshold value, the controlling section judges that the skew has been rectified, and continues to drive the line feed motor. As a result, the feed roller 12 is executed to rotate along a supplying-sheet direction, the print medium 13 is supplied to the printing section P1, and a print is executed in the printing section P1.

(Explanation of Detail Operation of Sheet Supply)

Next is to explain in detail control flowchart shown by FIG. 5 regarding sheet supply operation. Firstly, through turning on the printing apparatus, the position of the slip roller 11 is reset (Step S1). Then, the slip roller 11 is placed at a shelter position in a rotation direction so as to prevent the slip roller 11 from disturbing the conveyance of the print medium 13, which serves as a reset position of the slip roller 11. Between the conveyance route Rt and the slip roller 11, a predetermined distance exists.

Moreover, the pitch of the table sensors 14, for example, in the case that the smallest medium is 120 mm, is set to be less than smallest medium/2, for example, 57 mm so that at least two table sensors 14 can detect the smallest medium when the smallest medium is set.

Then, operator puts the print medium 13 onto the table 16 so as to make the print medium 13 covers at least one of plural roller substance sections 11*b* to construct the slip roller 11 (Step S2).

After the print medium 13 is put, the skew rectifying motor (not shown) is driven to operate, the slip roller 11 is made to rotate and the print medium 13 is conveyed (Step S3). Through the slip roller 11, the front edge of the print medium 13 touches the feed roller 12, the skew which occurred when putting the print medium 13 is rectified.

As a result of skew rectification, in the case that the print medium 13 is not set on the table sensor 14, for example, when user has pulled out the set print medium 13, the process will not enter next step (Step S4).

Then, the space motor (not shown in drawings) is made to operate and the carriage operation is started. The carriage is so positioned at that time, as shown by FIG. 6, as to face a most left-edge position (a point) in which the table sensor 14 detected that the print medium 13 exists, and in order to make the skew sensor 39*a* certainly detect the upper edge of the print medium 13 while supplying sheet, the skew sensor 39*a* is placed to a position (b point) keeping a right margin (for example, 5 mm) with respect to point a (Step S5).

Through setting the carriage position to the above stated position, while supplying sheet, not only the upper edge of the print medium 13 can be certainly detected, but also the upper edge of the print medium 13 can be controlled by the head protector 40.

Next is to convey the print medium 13 to the printing section P1 (Step S6) and to watch if the upper edge of the print medium 13 has passed one of the skew sensor 39*a* and skew sensor 39*b* (Step S7). Then, a line feed quantity from the time when one of the skew sensor 39*a* and skew sensor 39*b* detected the upper edge of the print medium 13, till the time when sheet supply ends, that is, a longitudinal width of the print medium 13 is set.

Then, the line feed motor (not shown) is driven per one pulse (for example, 1/360 inch), since the skew sensor 39*a* and skew sensor 39*b* respectively detect the upper edge of the print medium 13, the line feed quantity starts to be counted by a shift counter (Y1 value), and through using a timing at that both of the skew sensor 39*a* and skew sensor 39*b* detected the upper edge of the print medium 13, an inclination counter (Y2 value) starts to count up.

Then to judge whether the line feed of the width in long direction of the print medium 13 ended, as the line feed quantity till sheet supply ends (Step S8). If the remaining line feed quantity is 0, it is judged that the line feed of the width in long direction of the print medium 13 ended, next is to enter step S9, if it is judged that the line feed does not end yet, next is return to step S6, and is to execute a line feed of the remaining line feed quantity part.

Next is to calculate a skew quantity as a difference of the shift counter (Y1 value) and the inclination counter (Y2 value), that is, |Y1-Y2| (Step S9).

In the case that the difference |Y1-Y2| exceeds a threshold value, it is judged that there is a skew (Step S10). In the case that there is a skew, the print medium 13 is discharged (Step S11). Then, in the case that the skew is detected, if a retrying operation is less than three times, the process returns to step S3 and executes retrying operations from skew rectification operation. If a retrying operation has been executed three times, because it is impossible to rectify the skew, a warning display of an inclination error is executed (Step S12).

In the case that skew does not exist, by using the skew sensor 39*a* and the skew sensor 39*b*, the width of the print medium 13 is detected (Step S13). For example, if being such an example shown by FIG. 7A, the skew sensor 39*a* is moved to a position (point c) facing to a left sensor at the left hand of the most left edge sensor position (a point) in which the table sensor 14 detected the print medium exists, further is moved to a d point providing a predetermined margin.

As the example shown by FIG. 7B, in the case that there is not a sensor on the outside of the most left edge sensor position (a point) in which the table sensor 14 detected the print medium exists, the carriage is moved to a most left edge position (XL point) in a movable range.

Through the above operations, it is possible to certainly place the skew sensor 39*a* to the outside of the print medium 13. further, because the head protector 40 is placed in the print medium 13, even if the head protector 40 moves the print head 21 to the right, the print medium 13 is pressed, and the print medium 13 is not damaged.

Next is to detect the width of the print medium 13 while moving the carriage 41 to the right. That is, the position in which the skew sensor 39*a* firstly detected that the print medium 13 exists, is served as a left edge position of the print medium 13; and the position in which the skew sensor 39*b* finally detected that the print medium 13 exists and then becomes to un-exist, is served as a right edge position of the print medium 13 (Step S14).

Then, as shown by FIGS. 8A and 8B, is to move the head protector 40 so as to make the skew sensor 39*b* to place at a position (f point) which is over and faces to a right sensor at the right hand of the most right edge sensor position (e point) in which the table sensor 14 detected the print medium exists. Further, as shown by FIG. 8C, in the case that there is not a sensor on the outside of the most right edge sensor in which the table sensor 14 detected the print medium exists, the carriage is moved to a most right edge position (XR position) in a movable range (Step S15).

After detected the width of the print medium 13 through the above operations, the operation supplying sheet is ended. Then, as the explanation of whole operations, the controlling section judged that the skew is rectified and continues to drive the line feed motor. As a result, the feed roller 12 is made to rotate along a sheet supplying direction, the print medium 13 is supplied to the printing section P1, and a print is performed in the printing section P1.

Effect of Embodiment 1

As the above stated explanation, according to the printing apparatus of the embodiment 1, because it is possible to keep a predetermined margin at the inside of most left end sensor position in which table sensor detected the print medium exists to make skew sensor move, and to certainly detect skew, so it is unnecessary to arrange a great many skew sensors, and the apparatus cost can be reduced.

Further, because the print medium width can be detected bu using the skew sensor 39*a* and the skew sensor 39*b*, as compared with the case to detect by using table sensors placed by a predetermined interval, it is possible to correctly detect.

Embodiment 2

The printing apparatus of embodiment 2 is to move skew sensor, to detect upper edge of the print medium and to detect skew when the print medium width is narrow.

(Structure)

The summary structure, the main part of sheet supplying unit and the whole structure block of the printing apparatus in embodiment 2 are the same as the structure of the embodiment 1 shown by FIGS. 1, 2 and 3, their detail explanation will be omitted for simplification.

Figure 9:
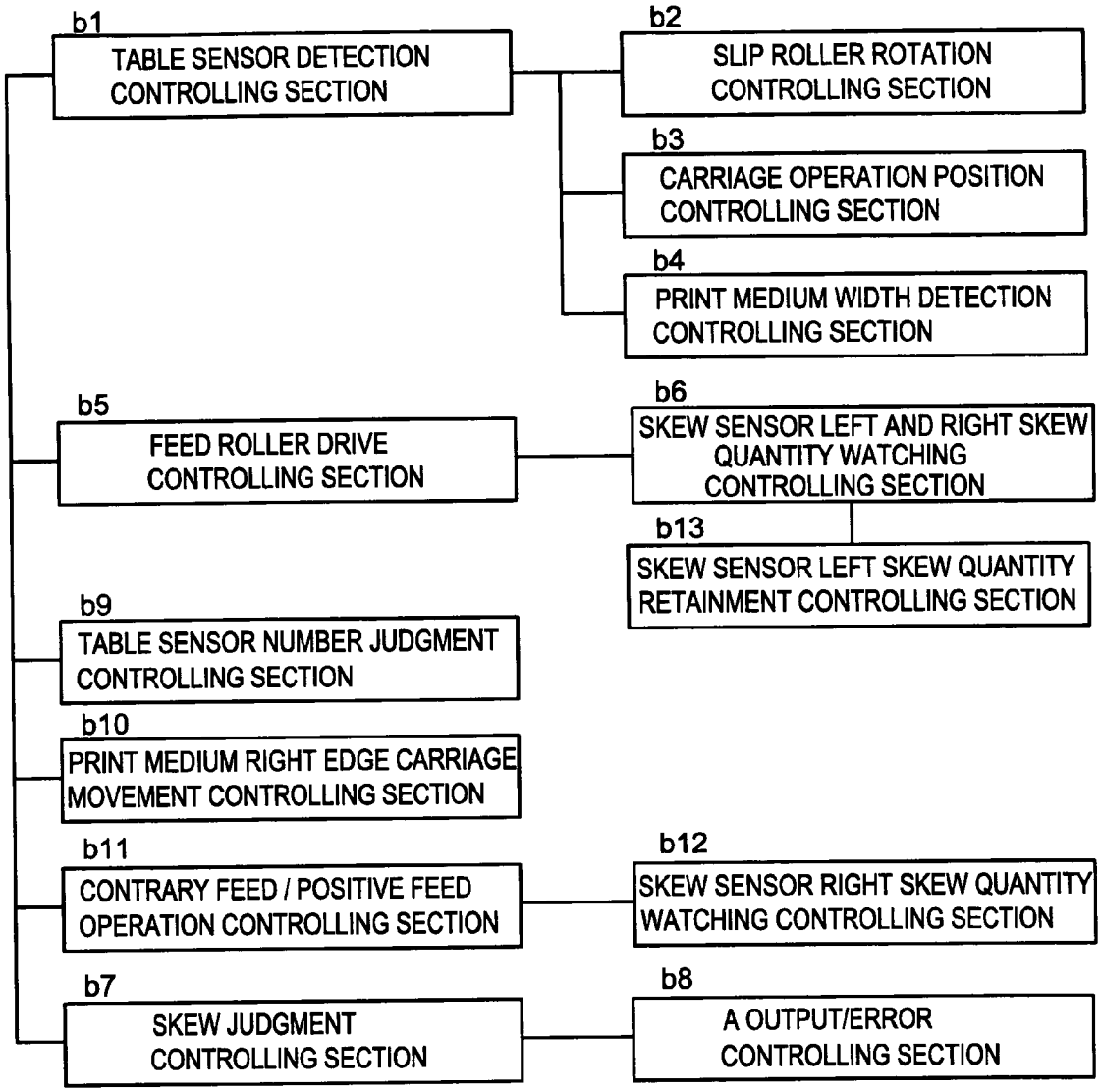
FIG. 9 is a firmware block diagram showing a printing apparatus in embodiment 2.

FIG. 9 is a firmware block diagram showing a printing apparatus in embodiment 2.

As shown by FIG. 9, the firmware block of the embodiment 2 has a structure added b9, b10, b11, b12 and b13 into the structure of the embodiment 1. Regarding other elements, they are the same as that in the embodiment 1, so the detail explanation of the same parts will be omitted for simplification.

Firstly, b9 is a table sensor number judgment controlling section for judging the number of table sensors having identified that the print medium exists; b10 is a print medium right edge carriage movement controlling section for moving right skew sensor to print medium right edge position; b11 is a contrary feed/positive feed operation controlling section for conveying print medium in second skew quantity watching; b12 is a skew sensor right skew quantity watching controlling section for watching a feed quantity from the upper edge of the print medium by using the right skew sensor; and b13 is a skew sensor left skew quantity retainment controlling section for retaining a skew quantity of left skew sensor in first skew quantity watching.

(Operation)

Through the above stated structure, the printing apparatus of the embodiment 2 performs the following operations.

Figure 10A:
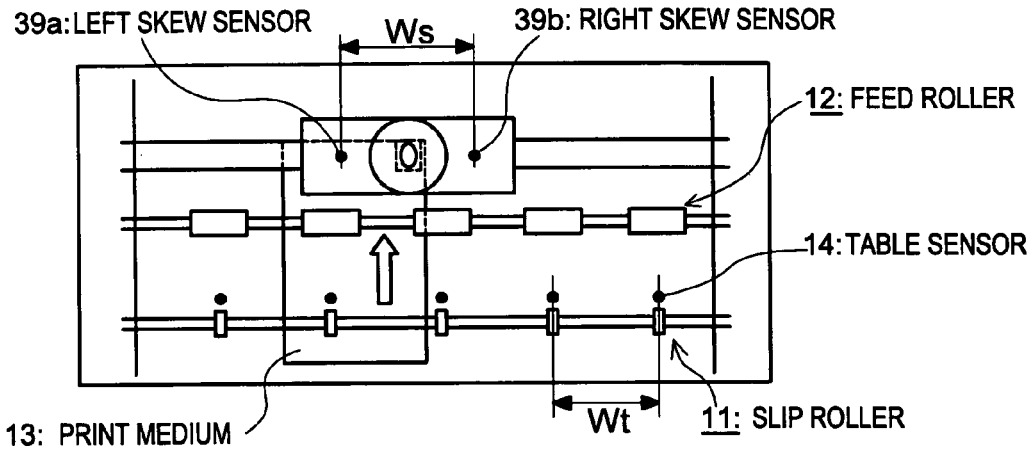
FIG. 10A is a first explanation diagram of carriage position after print medium width detection operation of embodiment 2.
Figure 10B:
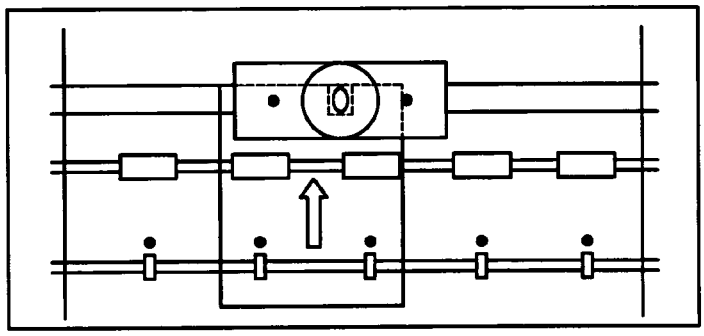
FIG. 10B is a second explanation diagram of carriage position after print medium width detection operation of embodiment 2.
Figure 10C:
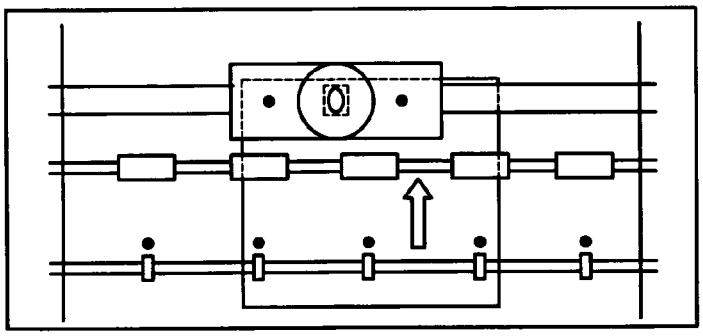
FIG. 10C is a third explanation diagram of carriage position after print medium width detection operation of embodiment 2.
Figure 11A:
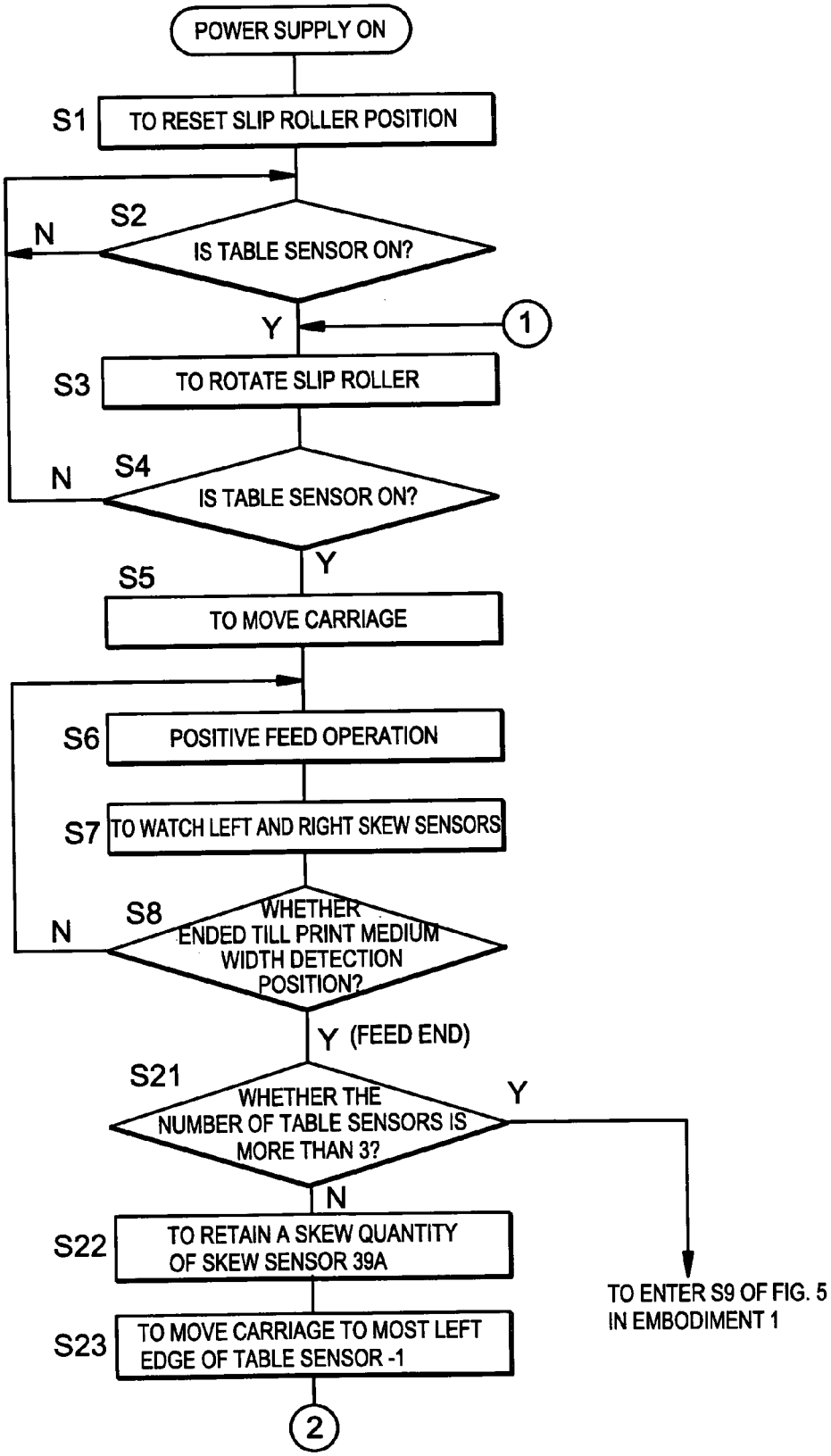
FIG. 11A is a control flowchart of a printing apparatus in embodiment 2 (1)
Figure 11B:
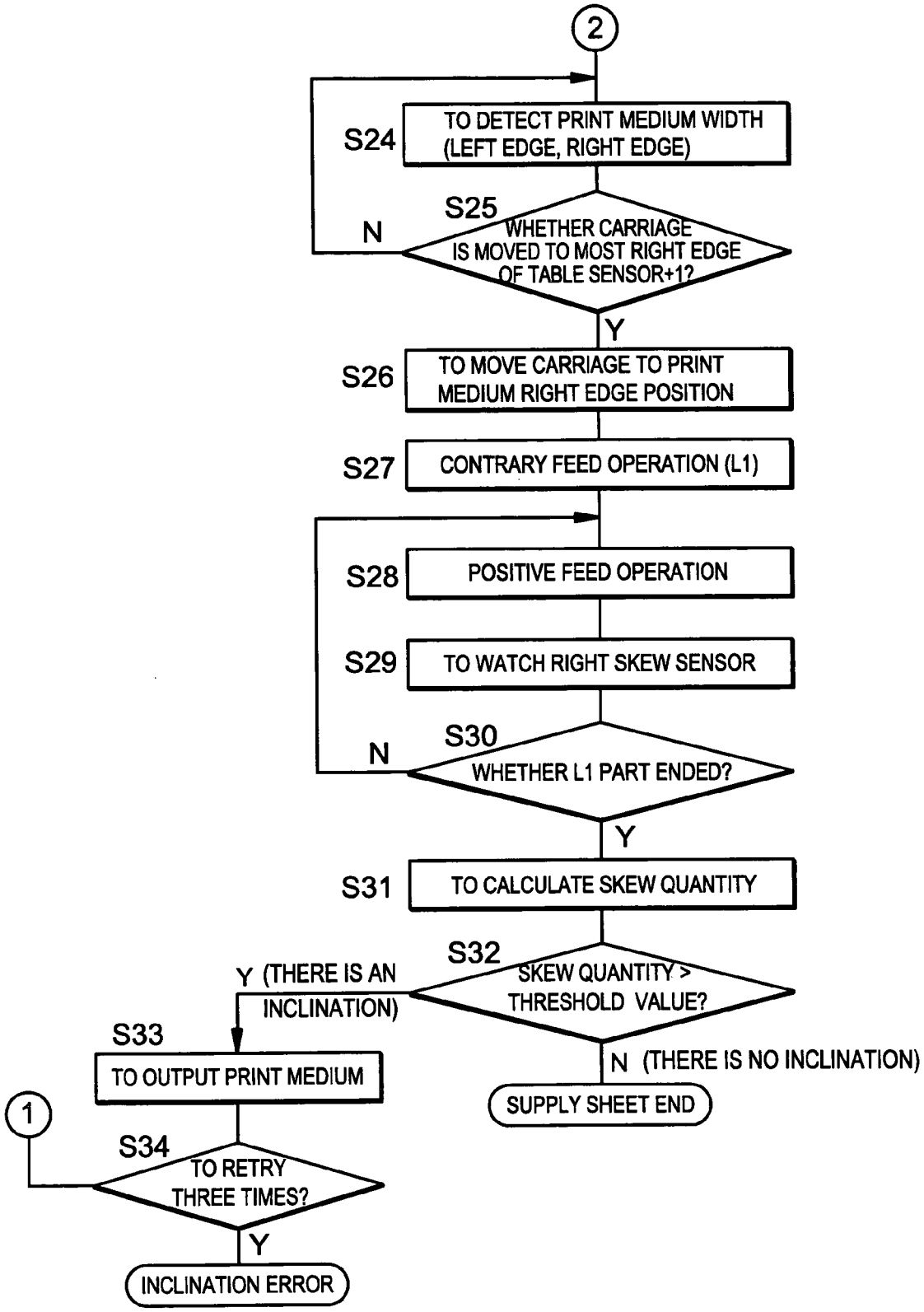
FIG. 11B is a control flowchart of a printing apparatus in embodiment 2 (2)
Figure 12A:
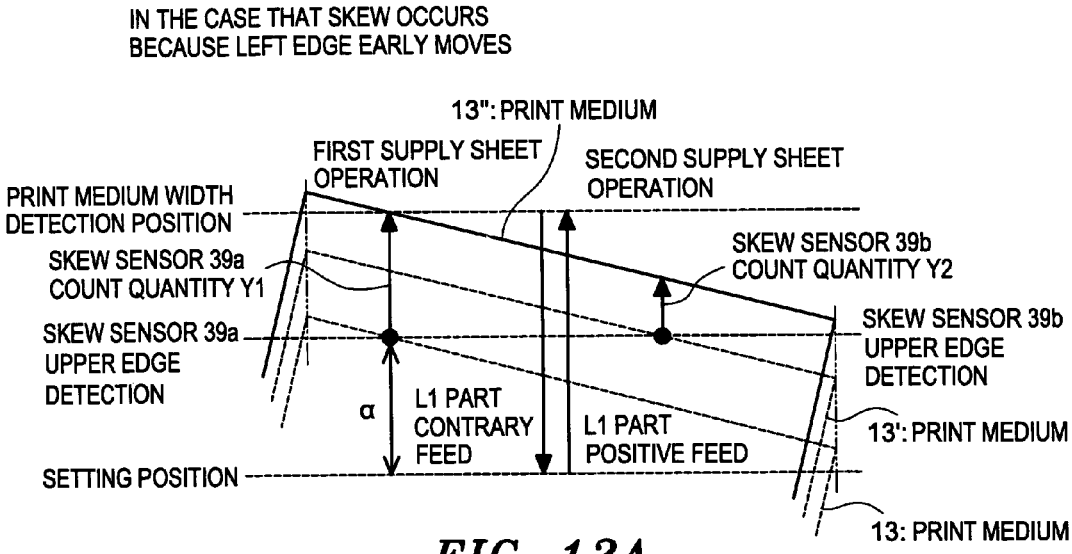
FIG. 12A is a first explanation diagram of conveyance operation of print medium in skew state in embodiment 2.
Figure 12B:
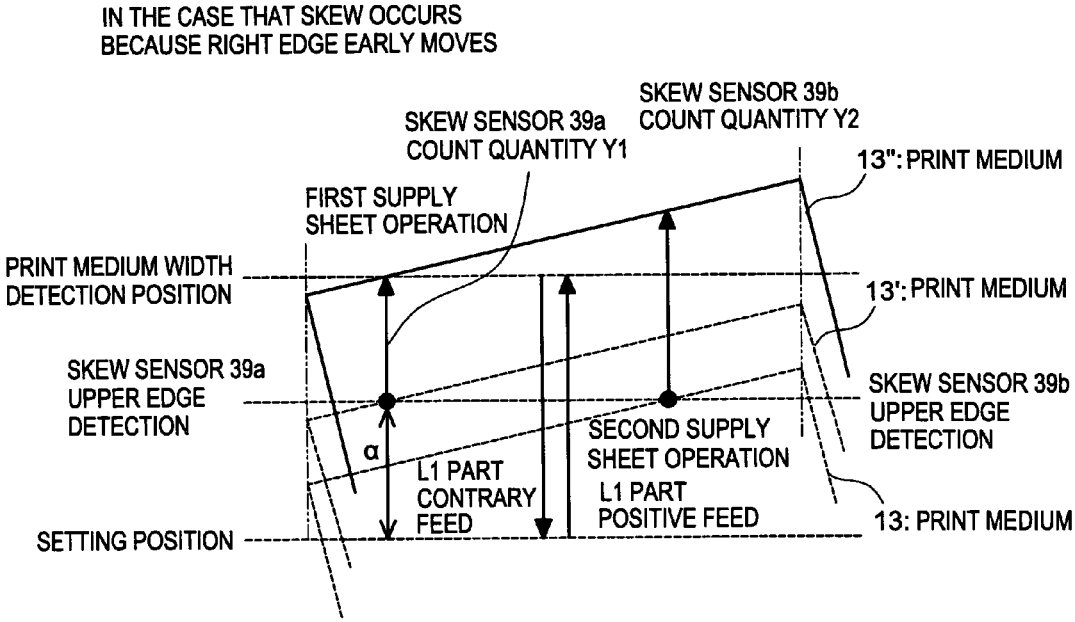
FIG. 12B is a second explanation diagram of conveyance operation of print medium in skew state in embodiment 2.

FIG. 10A is a first explanation diagram of carriage position after print medium width detection operation of embodiment 2; FIG. 10B is a second explanation diagram of carriage position after print medium width detection operation of embodiment 2; FIG. 10C is a third explanation diagram of carriage position after print medium width detection operation of embodiment 2; FIG. 11A is a control flowchart of a printing apparatus in embodiment 2 (1); FIG. 11B is a control flowchart of a printing apparatus in embodiment 2 (2); FIG. 12A is a first explanation diagram of conveyance operation of print medium in skew state in embodiment 2; and FIG. 12B is a second explanation diagram of conveyance operation of print medium in skew state in embodiment 2.

Firstly, as shown by FIG. 10A, it is better to set an interval Ws between the skew sensor 39*a* and the skew sensor 39*b* to be as shorter as possible than an interval Wt of the table sensors 14 as possible. For example, if print medium width is detected by two table sensors, the interval Ws is set to a half of the interval Wt (Wt/2), thus, the skew sensor 39*b* surely is on the inside of the print medium 13, so it can detect the upper edge of the print medium 13. However, if the interval Ws is shorter, the precision of skew detection is fallen, further, there is a limitation of dimension size of print head 21 and head protector 40, so it is necessary to enlarge the interval of the table sensors 14, Because of the above reasons, in the case that the print medium width is narrow, as shown by FIGS. 10A and 10B, such case occurred that only one of the skew sensors can perform a detection. The FIGS. 10A and 10B respectively showed such an example in which only one of the skew sensor 39*a* and the skew sensor 39*b* can detect the upper edge of the print medium 13 in the case that one table sensor performed a detection and in the case that two table sensors performed a detection. The FIG. 10C showed such an example in which three table sensors performed a detection and the skew sensor 39*a* and the skew sensor 39*b* all can detect the upper edge of the print medium 13.

Next is to explain sheet supply operation of the embodiment 2 by using control flowchart of the FIG. 11. Moreover, regarding the steps S1-S8 of the FIG. 11, because they are the same as that in embodiment 1, their detail explanations are omitted.

In the step S8, after the sheet supply in a long direction of the print medium 13 ended, the process enters step S21, the number of the table sensors that detected that the print medium 13 exists is judged with respect to all table sensors 14.

In the case that the number of the table sensors is more than 3, that is, when any one of the skew sensor 39*a* and the skew sensor 39*b* all can detect the print medium, the process enters step S9 in FIG. 5 being a flowchart of the embodiment 1, and performs to judge whether the skew exists through a skew quantity. When it is judged that the there is not a skew, the print medium width is detected and the head protector 40 is moved to a predetermined position; when it is judged that there is a skew, the print medium 13 is discharged (steps S10-S15).

In the case that the number of the table sensors is 1 or 2, that is, only one of the skew sensor 39*a* and the skew sensor 39*b* can detect the print medium, the process enters step S22, and retains an inclination count (Y1) from the upper edge of the print medium 13 detected by the skew sensor 39*a* in step S7. The inclination count (Y1) in the skew sensor 39*a* is a line feed quantity obtained from that the upper edge of the print medium 13 is detected to that the width in conveyance direction of the print medium 13, it is a fixed quantity.

Then, in order to execute detection operation of the print medium width using the skew sensor 39*a* and the skew sensor 39*b*, the skew sensor 39*a* is moved to a position (f point) which is over and faces to a left sensor at the left hand of the most left edge sensor in which the table sensor 14 detected the print medium exists (Step S23). In the case that there is not a sensor on the outside of the most left edge sensor in which the table sensor 14 detected the print medium exists, the carriage is moved to a most left edge position in a movable range.

Next is to detect the print medium width while moving the carriage 41 to the right. That is, the skew sensor 39*a* detects the left edge of the print medium and recognizes the detected position to serve as a print medium left edge position. The skew sensor 39*b* detects the right edge of the print medium and recognizes the detected position in which the print medium 13 is finally detected existing and is detected unexisting to serve as a print medium right edge position (Step S24).

Then is to move the head protector 40 so as to make the skew sensor 39*b* to place at a position which is over and faces to a right sensor at the right hand of the most right edge sensor in which the table sensor 14 detected the print medium exists (Step S25). In the case that there is not a sensor on the outside of the most right edge sensor in which the table sensor 14 detected the print medium exists, the carriage is moved to a most right edge position in a movable range.

Next is to move carriage so as to make skew sensor 39*b* place at the print medium right edge position (Step S26). In order to make the skew sensor 39*b* certainly detect the upper edge of the print medium, the skew sensor 39*b* is placed on the inside of the print medium with respect to the print medium right position.

Then, as shown by FIG. 12A, is to execute a contrary feed operation by L1 part. The feed quantity L1 at that time is a feed quantity $\alpha$ from a set position of the print medium to a position of the skew sensor 39*a*+a feed quantity till a detection position of the print medium, also is a quantity till a position in which the tip of the print medium does not come off the feed roller (Step S27).

Then is to execute again a positive feed operation by L1 part as second sheet supply, and to convey the print medium 13 toward the printing section P1 (Step S28), further to start to update an inclination count (Y2 value) at a timing when the skew sensor 39*b* detected the upper edge, and to positively update the line feed motor (not shown) per one pulse (for example, 1/360 inch) (Step S29). Furthermore, the set line feed quantity (L1) negatively updates the line feed motor (not shown) per one pulse (for example, 1/360 inch).

Then is to judge whether the line feed of L1 part ended or not as a line feed quantity till the sheet supply ended (Step S30). When the line feed quantity becomes 0 and the line feed ended, the process enters step S31.

Next is to execute a calculation of skew quantity (Step S31). That is to find a inclination count difference between the inclination count of the skew sensor 39*a* in first sheet supply and the inclination count of the skew sensor 39*b* in second sheet supply, as |Y1-Y2|.

Through an alike method, as shown by FIG. 12B, in the case that the right edge earlier moves, through performing the same operations, a skew quantity |Y1-Y2| is obtained.

When the skew quantity exceeds a threshold value and it is judged that there is a skew (Step S32), the process is to enter step S33 and to output the print medium 13, then to perform retrying operation from skew rectification operation in step S3. If the retrying operation has been executed three times, because it is impossible to rectify the skew, a warning including skew contents is displayed (Step S34).

In the case that the skew quantity is less than the threshold value and it is judged that there is not a skew, the sheet supply operation is ended, and as explained in whole operation, the main controlling section 30 judged that the skew is rectified and drives the line feed motor to continue. As a result, the feed roller 12 is made to rotate along a sheet supplying direction, the print medium 13 is supplied to the printing section P1, and a print is performed in the printing section P1.

Effect of Embodiment 2

As the above stated explanation, according to the printing apparatus of the embodiment 2, because it is possible to move the skew sensors to left and right predetermined positions, to execute sheet supply operation in the respective positions, and to obtain a skew quantity by skew sensor, adding the effect of the embodiment 1, even if in the case that the print medium width is narrow, it is possible to certainly detect the skew state of the print medium 13.

Embodiment 3

The printing apparatus of embodiment 2, when the skew sensor does not place at a position keeping a predetermined margin at inside of the print medium while skew detection, is to move again the skew sensor to the inside of the print medium and to perform a skew detection.

(Structure)

The summary structure, the main part of sheet supplying unit and the whole structure block of the printing apparatus in embodiment 3 are the same as the structure of the embodiment 1 shown by FIGS. 1, 2 and 3, their detail explanation will be omitted for simplification.

Figure 13:
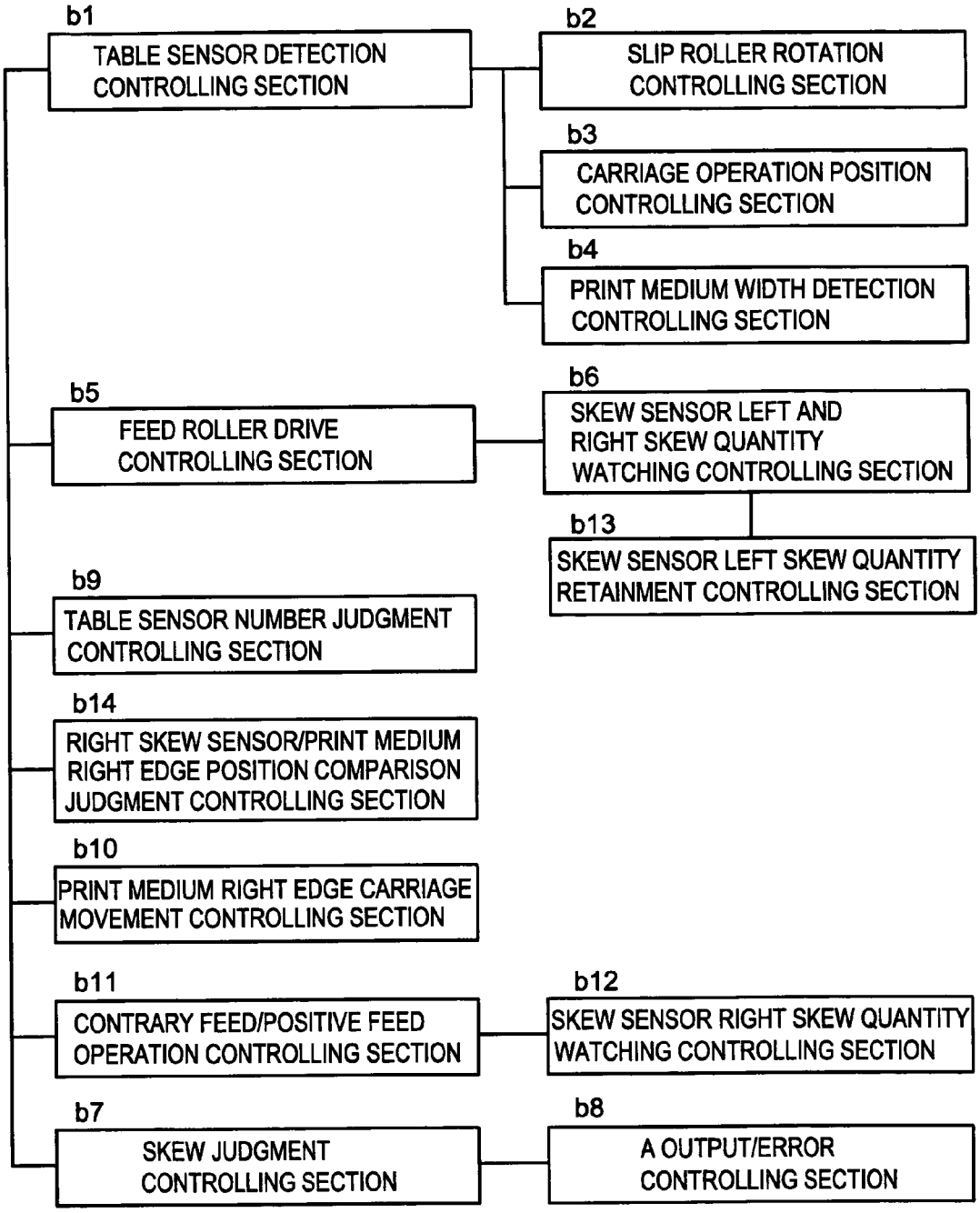
FIG. 13 is a firmware block diagram showing a printing apparatus in embodiment 3.

Further, the firmware block of the embodiment 3, as shown by FIG. 13, is added a right skew sensor/print medium right edge position comparison judgment controlling section b14 to the embodiment 2 while print medium conveyance. Regarding other elements, they are the same as that in the embodiment 2, so the detail explanation of the same parts will be omitted for simplification.

The right skew sensor/print medium right edge position comparison judgment controlling section b14, is a right skew sensor/print medium right edge position comparison judgment controlling section for comparing and judging the right skew sensor position while supplying print medium and the print medium right edge position.

(Operation)

Figure 14:
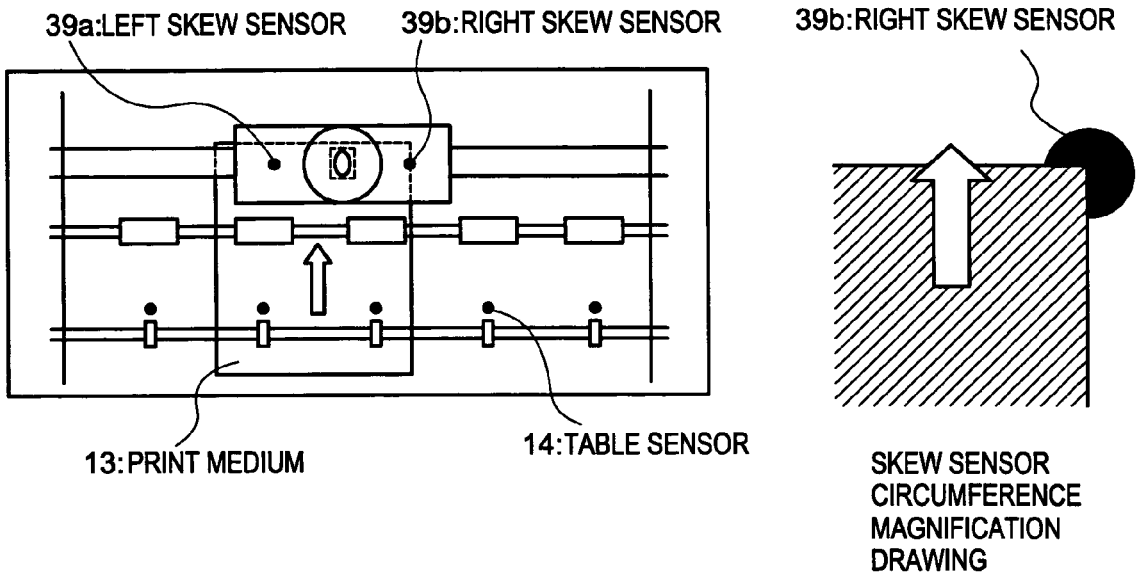
FIG. 14 is an explanation diagram of carriage position after print medium width detection operation of embodiment 3.
Figure 15A:
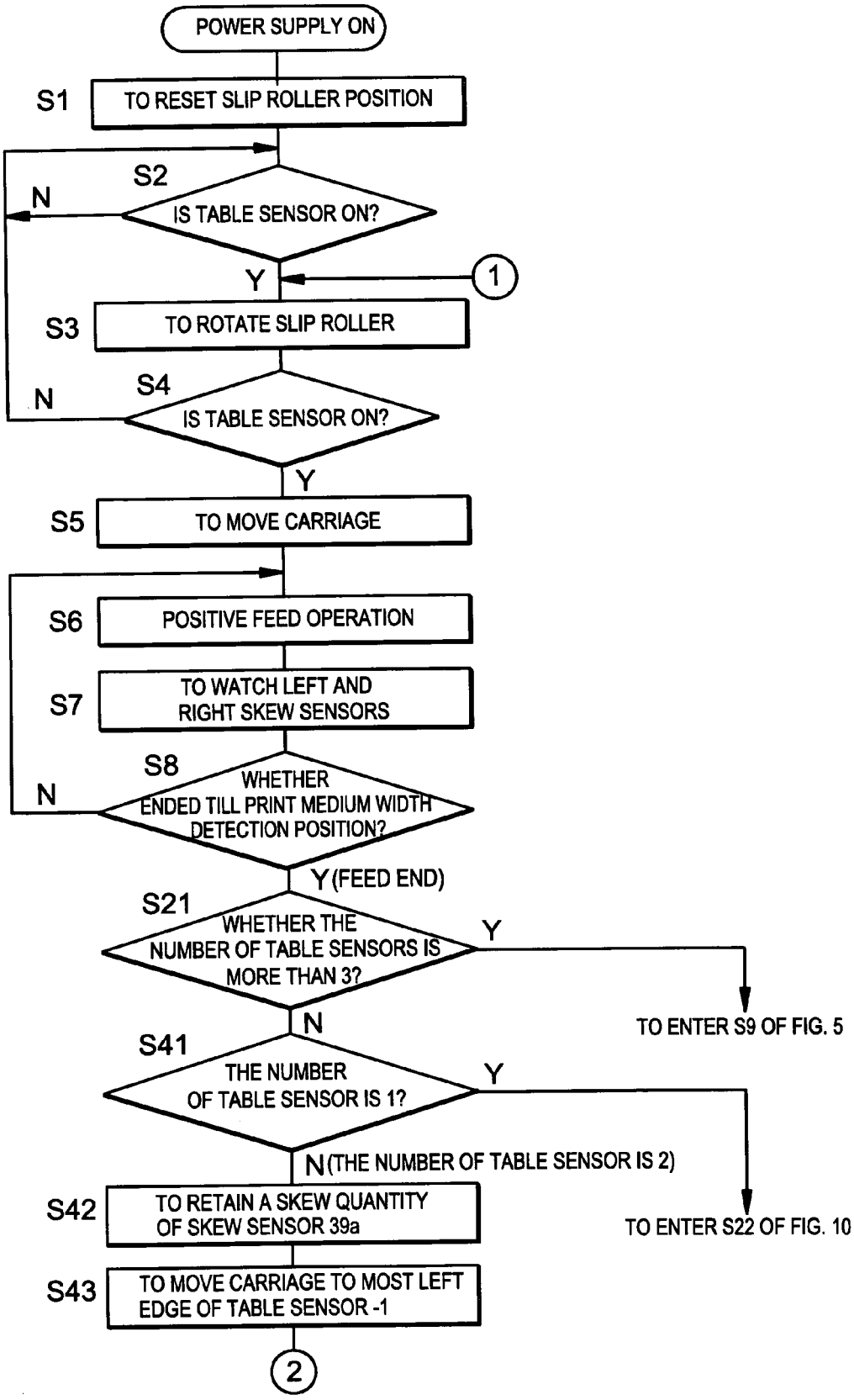
FIG. 15A is a flowchart of print medium width detection operation in embodiment 3 (1)
Figure 15B:
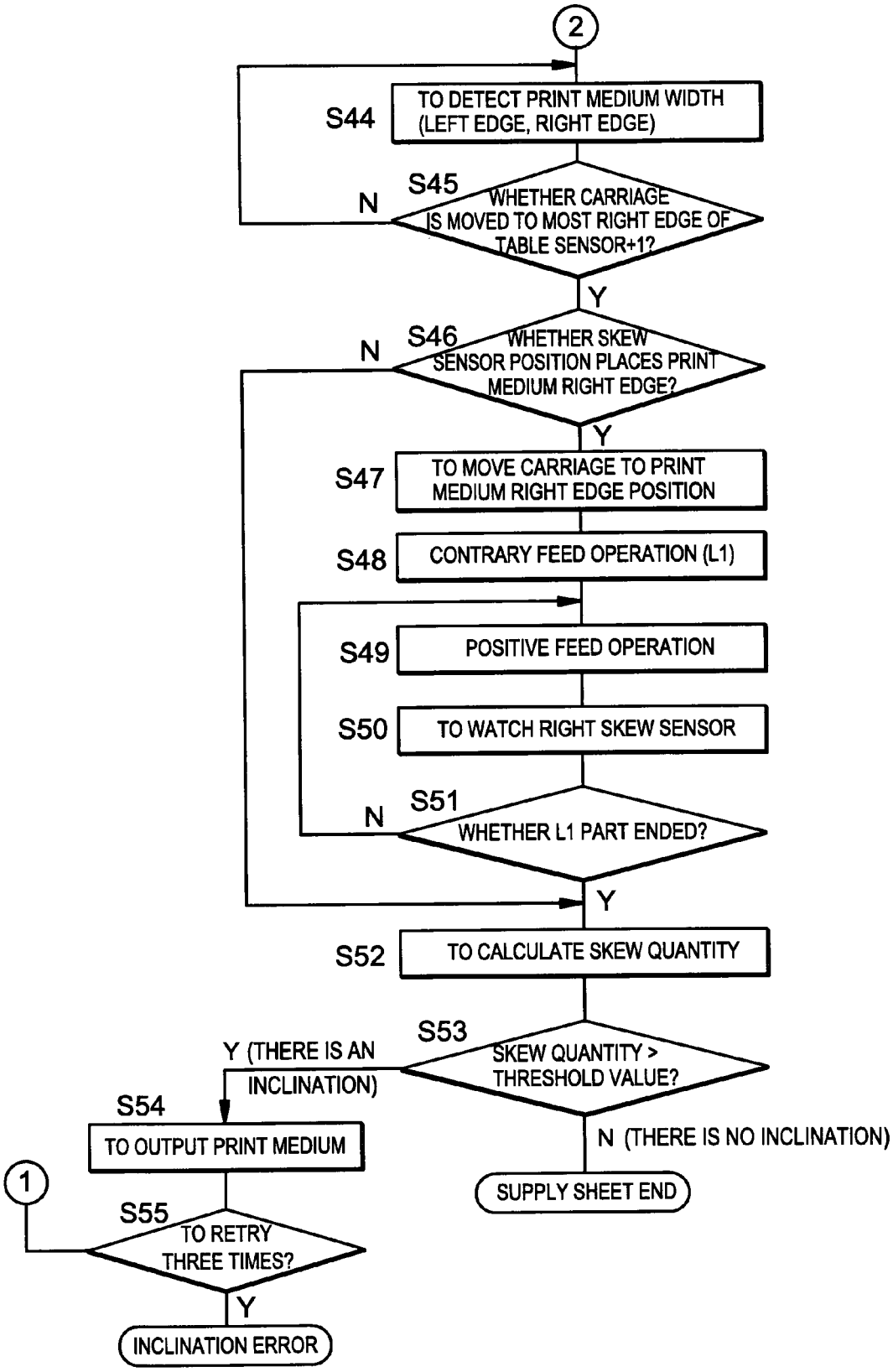
FIG. 15B is a flowchart of print medium width detection operation in embodiment 3 (2)

FIG. 13 is a firmware block diagram showing a printing apparatus in embodiment 3; FIG. 14 is an explanation diagram of carriage position after print medium width detection operation of embodiment 3; FIG. 15A is a flowchart of print medium width detection operation in embodiment 3 (1); and FIG. 15B is a flowchart of print medium width detection operation in embodiment 3 (2).

Firstly, as shown by the FIG. 14, the skew sensor 39*b* is placing a position to correspond to a part of the print medium 13, and in the FIG. 14, a magnification drawing of the skew sensor 39*b* and its circumference is shown for definitely explaining operation.

In the state shown by the FIG. 14, when executing the skew detection of the print medium 13, an error on the upper edge detection position of the print medium 13 occurs. That is, though there is not a skew, a skew is detected mistakenly; and though there is a skew, a skew nonexistence is detected mistakenly.

The printing apparatus of the embodiment 3, in order to prevent such mistake from occurring, performs the following operations. The operations are explained by using the control flowchart of the FIG. 15. Moreover, regarding the steps S1-S8, because they are the same as that in embodiment 1, their detail explanations are omitted. Regarding the case that in the step S8, after the sheet supply in a long direction of the print medium 13 ended, the process enters step S21, it will be explained.

In the step S21, the number of the table sensors that detected that the print medium 13 exists is judged with respect to all table sensors 14. On the one hand, in the case that the number of the table sensors is more than 3, the process enters step S9 in FIG. 5 being a flowchart of the embodiment 1, and performs to judge whether the skew exists through a skew quantity. When it is judged that the there is not a skew, the print medium width is detected and the head protector 40 is moved to a predetermined position; when it is judged that there is a skew, the print medium 13 is discharged (steps S10-S15).

On the other hand, in the case that the number of the table sensors is 1 or 2, a judgment process is performed based on the table sensor number to corresponding to the table sensors 14 that detected that the print medium 13 exists (Step S41). When the number of the table sensors is 1, the process is to enter step S22 of the FIG. 10 being flowchart explained in embodiment 2. That is, the detection operation of print medium width is executed, then while executing contrary feed operation or positive feed operation, through the skew sensor 39*a* and the skew sensor 39*b*, the skew quantity is detected, if the skew quantity exceeds a threshold value, a skew rectification is performed, if the skew quantity is less than the threshold value, the print medium 13 is supplied to the printing section P1 (Steps S22-S34).

Further, in the case that the number of the table sensor is more than 1, that is, is 2, an inclination count quantity (Y1 value) from the print medium upper edge detected by the skew sensor 39*a* is retained (Step S42).

Then, as explanation using the FIG. 7, in order to execute detection operation of the print medium width, the skew sensor 39*a* is moved to a position which is over and faces to a left sensor at the left hand of the most left edge sensor in which the table sensor 14 detected the print medium exists. In the case that there is not a sensor on the outside of the most left edge sensor in which the table sensor 14 detected the print medium exists, the carriage is moved to a most left edge position in a movable range (Step S43).

Next is to detect the print medium width while moving the carriage 41 to the right. That is, the skew sensor 39*a* recognizes the position in which firstly detected that the print medium 13 exists to serve as a print medium left edge position; and the skew sensor 39*b* recognizes the position in which finally detected that the print medium 13 is existing then un-existing to serve as a print medium right edge position (Step S44).

As explanation using the FIG. 8, then is to move the carriage 41 so as to make the skew sensor 39*b* to place at a position which is over and faces to a right sensor at the right hand of the most right edge sensor in which the table sensor 14 detected the print medium exists. In the case that there is not a sensor on the outside of the most right edge sensor in which the table sensor 14 detected the print medium exists, the carriage is moved to a most right edge position in a movable range (Step S45).

After detected the print medium width, on the one hand, it is judged whether the position in which the skew sensor 39*b* detected the print medium upper edge in step S7 places at the right edge of the print medium 13. That is, the position of the skew sensor 39*b* places at the right side of (print medium right position-margin), it is judged that the position is not at the print medium right edge and that there possibly is mistaken detection. Then, as stated below, the process enters step 47 to move the skew sensor 39*b* in a range of the print medium 13 and to detect skew again (Step S46).

On the other hand, in the case that the position of the skew sensor 39*b* places at the left side of (print medium right position-margin), it is judged that the position is at the print medium right edge and that the skew detection can be performed with a high precision, then a skew calculation is continued to perform (Step S52).

Next is to move head protector 40 so as to make skew sensor 39*b* place at the print medium right edge position. In order to make the skew sensor 39*b* certainly detect the upper edge of the print medium, the skew sensor 39*b* is placed on the inside of the print medium with respect to the print medium right edge position (Step S47).

Then is to execute a contrary feed operation (Step S48). The feed quantity at that time is a quantity from a current position to a position of the skew sensor 39*a*+α part, that is, a quantity of L1 part till a position in which the tip of the print medium does not come off the feed roller is moved. Then is to execute a positive feed operation, and to convey the print medium 13 toward the printing section P1 (Step S49).

Further is to start to update an inclination count at a timing when the skew sensor 39*b* detected the upper edge, and to update the line feed motor (not shown) per one pulse (for example, 1/360 inch) (Step S50. Furthermore, the set line feed quantity (L1) negatively updates the line feed motor (not shown) per one pulse (for example, 1/360 inch).

Then is to judge whether the line feed quantity (in the case: L1 part) till ending the sheet supply ended (Step S51). When the line feed quantity becomes 0, it becomes the print medium width detection position and the line feed is ended, further a calculation of the skew quantity is performed. That is to request a inclination count difference between the inclination count of the skew sensor 39*a* in first sheet supply and the inclination count of the skew sensor 39*b* in second sheet supply (Step S52).

When these distance difference exceeds a threshold value and it is judged that there is a skew state (Step S53). In the case that a skew exists, the process is to output the print medium 13 (Step S54). In the case that the skew is detected, a retrying operation from skew rectification operation in step S3 is executed, if the retrying operation has been executed three times, a warning including skew state contents is displayed (Step S55).

On the other hand, in the case that there is not a skew, the sheet supply operation is ended. Moreover, in step S46, the position of the skew sensor 39*b* is at the inside of the print medium 13, because it is unnecessary to execute again sheet supply, in the skew quantity calculation in the step S52, a difference of the respective inclination counts of the skew sensor 39*a* and the skew sensor 39*b* in step S7 is obtained, then in the case that these distance difference in the step S53 exceeds a threshold, a skew state is judged.

Effect of Embodiment 3

As the above stated detail explanation, according to the printing apparatus of the embodiment 3, when the skew sensor while skew detection does place a position keeping a predetermined margin at the inside of the print medium 13, because executed to move again the skew sensor to the inside of the print medium 13 and to detect the inclination movement, it is possible to prevent the mistaken detection of skew state from happening.

Embodiment 4

The printing apparatus of embodiment 4 is to make a skew judgment quantity change according to print medium width.

(Structure)

The summary structure, the main part of sheet supplying unit and the whole structure block of the printing apparatus in embodiment 4 are the same as the structure of the embodiment 1 shown by FIGS. 1, 2 and 3, their detail explanation will be omitted for simplification.

Figure 16:
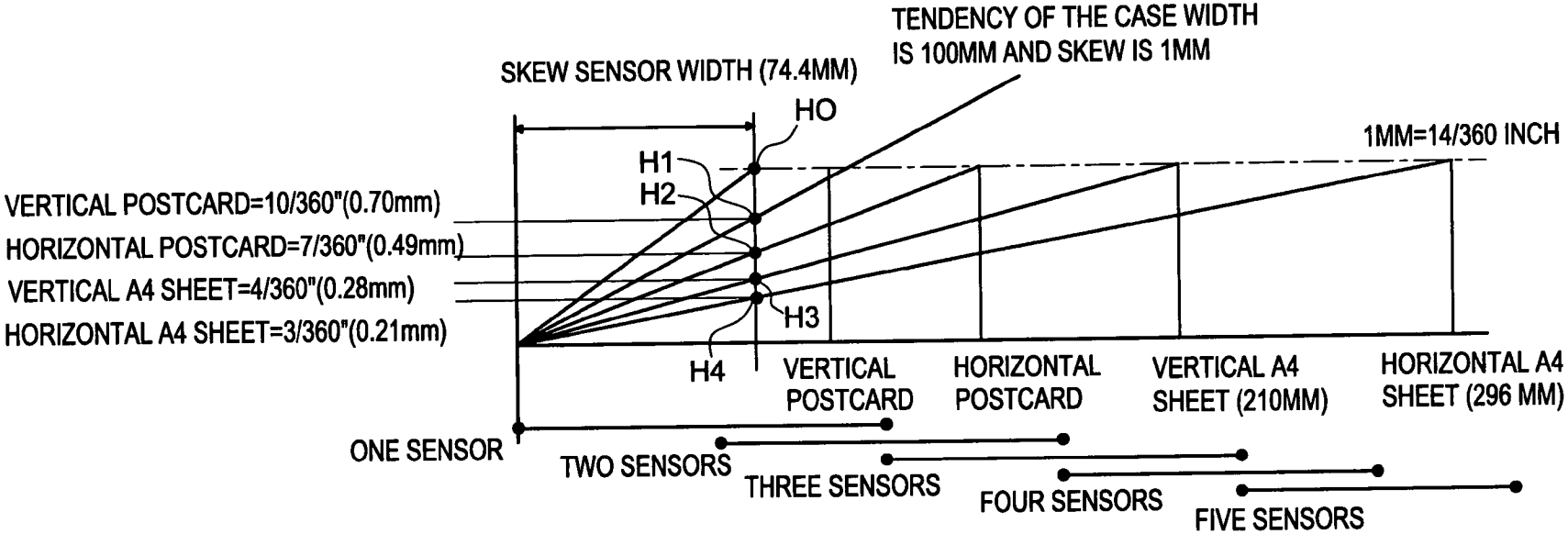
FIG. 16 is an operation explanation diagram of a printing apparatus in embodiment 4.

FIG. 16 is an operation explanation diagram of a printing apparatus in embodiment 4. The FIG. 16 showed a standard value of skew judgment in the case that the skew quantity is 1 mm standard value and a skew sensor width Ws is 74.4 mm. That is, H0 point in drawing is a skew judgment standard value in the case that the print medium width is a skew sensor width; H1 point is a skew judgment standard value in the case that the print medium is a vertical postcard and the print medium width is 100 mm; H2 point is a skew judgment standard value in the case that the print medium is a horizontal postcard; and H3 and H4 points respectively are skew judgment standard values in the case that the print medium respectively are a vertical A4 sheet and a horizontal A4 sheet.

Further, the width described the lower side in FIG. 16, indicated the number of the table sensor 14 that detected the print medium 13 while setting the print medium 13 to the table 16. For example, the print medium 13 which is detected by one table sensor 14 is such sheet whose size is larger than vertical postcard width and is smaller than a length which is little longer than the vertical postcard width. Then, the print medium widths respectively detected by two, three, four and five table sensors, is shown in sequence.

Figures 17, 18:
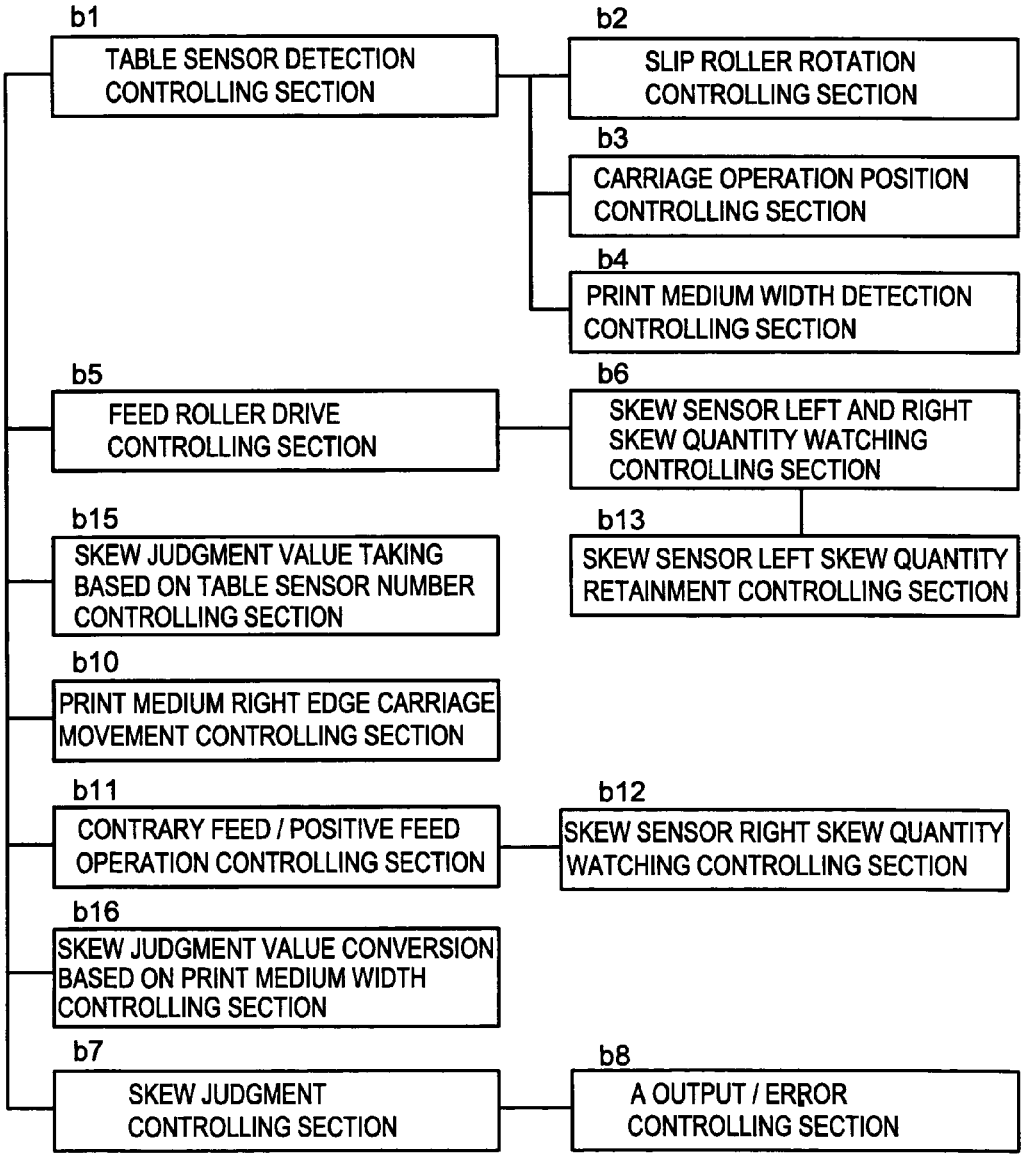
FIG. 17 is an example diagram of skew judgment quantity of a printing apparatus in embodiment 4.
FIG. 18 is a firmware block diagram showing a printing apparatus in embodiment 4.

FIG. 17 is an example diagram of skew judgment quantity of a printing apparatus in embodiment 4.

The skew judgment standard value as shown by FIG. 17, is set per a predetermined table sensor detection number, and changes with the number of the table sensor detected that the print medium 13 exists. For example, in the case that the print medium 13 is a horizontal postcard or is a vertical A4 sheet, as shown by FIG. 16, the number of the table sensors 14 almost is three, then, when three table sensors performed detection operation, the skew judgment standard value is set to 7/360 inch+predetermined margin (H2 point). In the same way, when one table sensor performed detection operation, the skew judgment standard value is set to 10/360 inch+predetermined margin (H1 point); when five table sensors performed detection operation, the skew judgment standard value is set to 3/360 inch+predetermined margin (H4 point). Moreover, it may be performed, that is, as described below, without using table, on the basis of the print medium width measured by using the skew sensor 39*a* and the skew sensor 39*b*, through a (1) expression, the skew judgment standard value is directly calculated.

FIG. 18 is a firmware block diagram showing a printing apparatus in embodiment 4.

The firmware block of the embodiment 4, as shown by FIG. 18, is added a skew judgment value taking based on table sensor number controlling section b15 and a skew judgment value conversion based on print medium width controlling section b16 to the embodiment 3. Regarding other elements, they are the same as that in the embodiment 3, so the detail explanation of the same parts will be omitted for simplification.

The skew judgment value taking based on table sensor number controlling section b15 is a controlling section to take out a skew judgment value on the basis of a table sensor number in order to prepare a skew judgment value with respect to a first skew quantity; the skew judgment value conversion based on print medium width controlling section b16 is a controlling section to convert the skew judgment value on the basis of a print medium width in order to prepare a skew judgment value with respect to a second skew quantity.

(Operation)

Figure 19A:
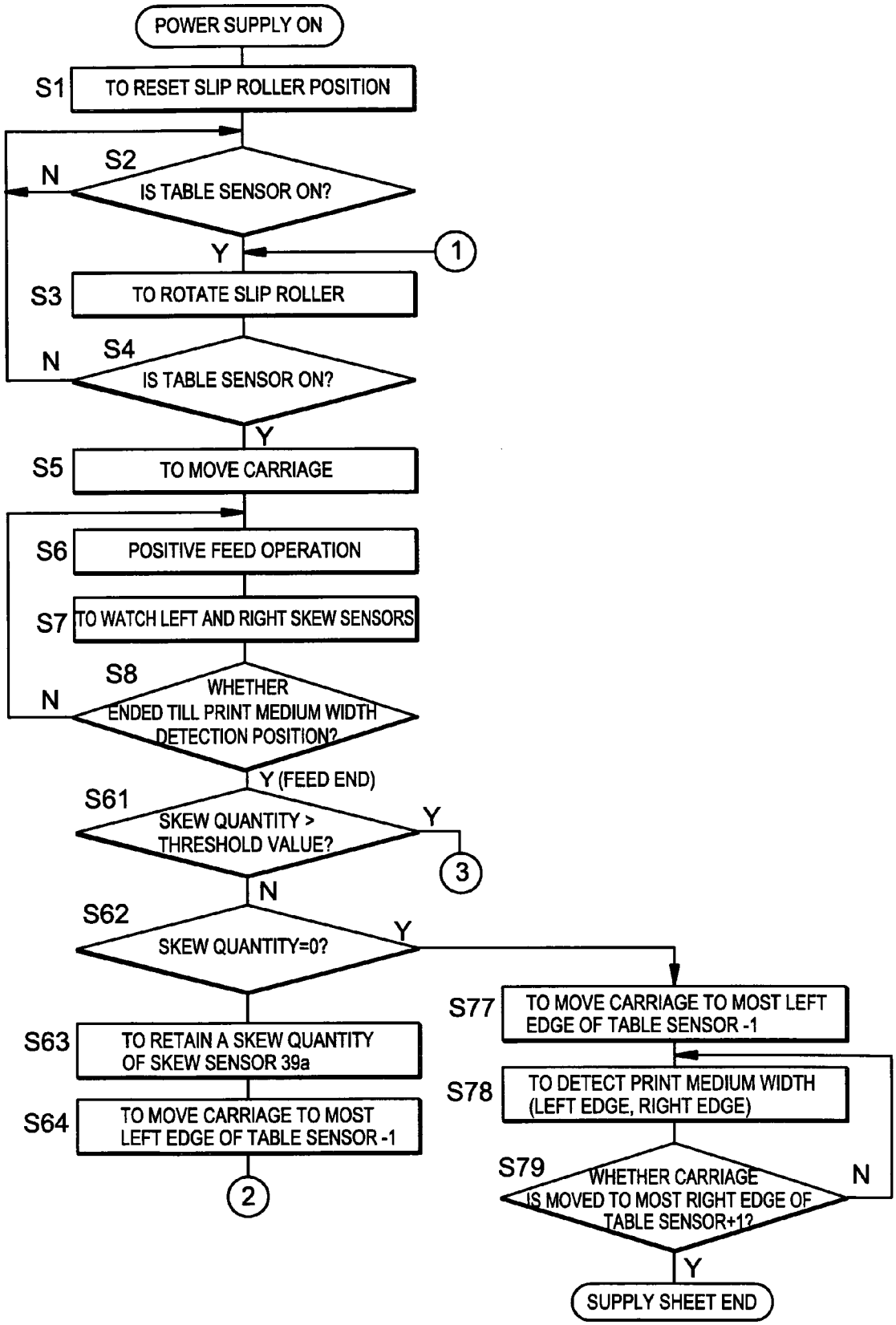
FIG. 19A is a control flowchart of a printing apparatus in embodiment 4 (1)
Figure 19B:
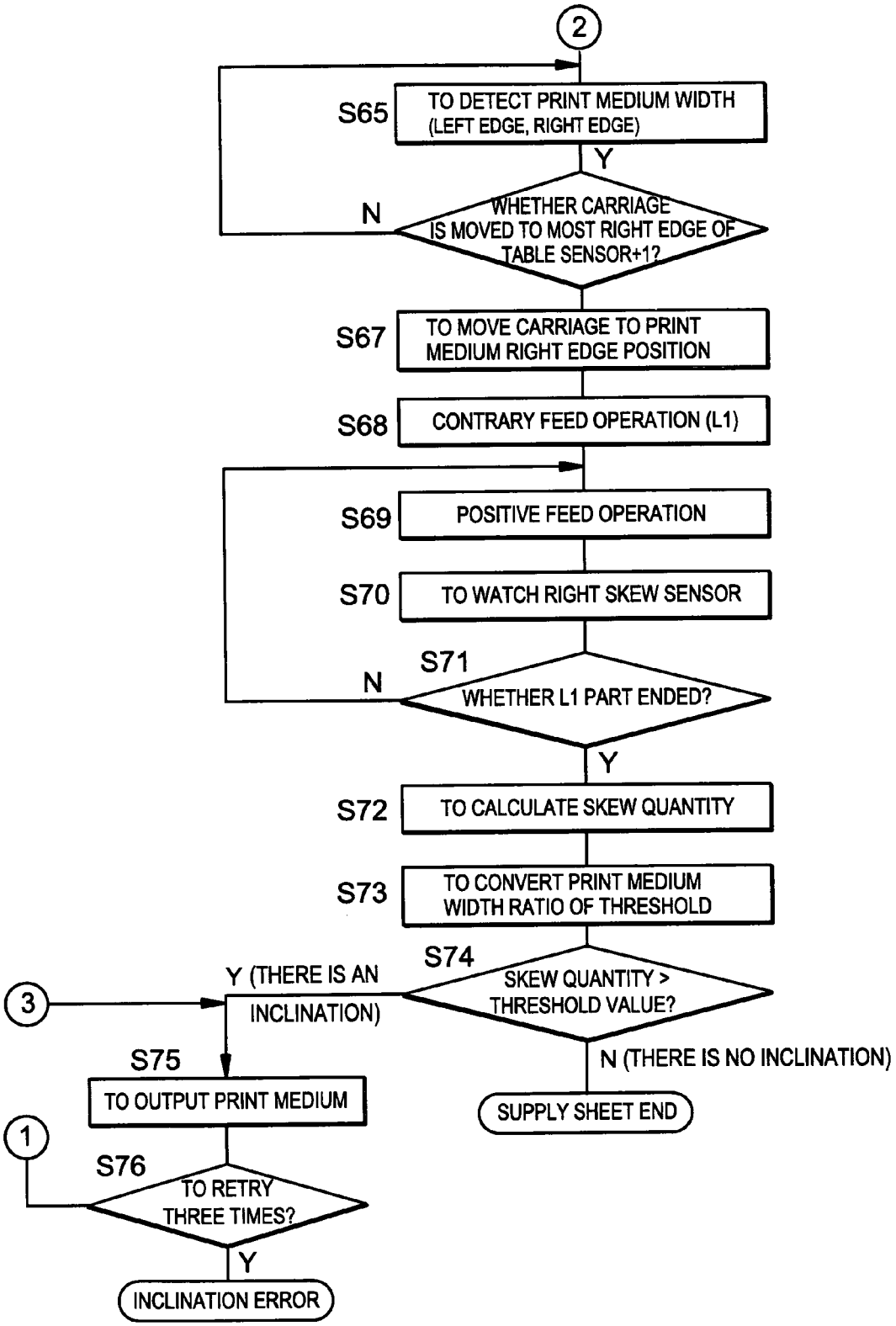
FIG. 19B is a control flowchart of a printing apparatus in embodiment 4 (2)
Figure 20:
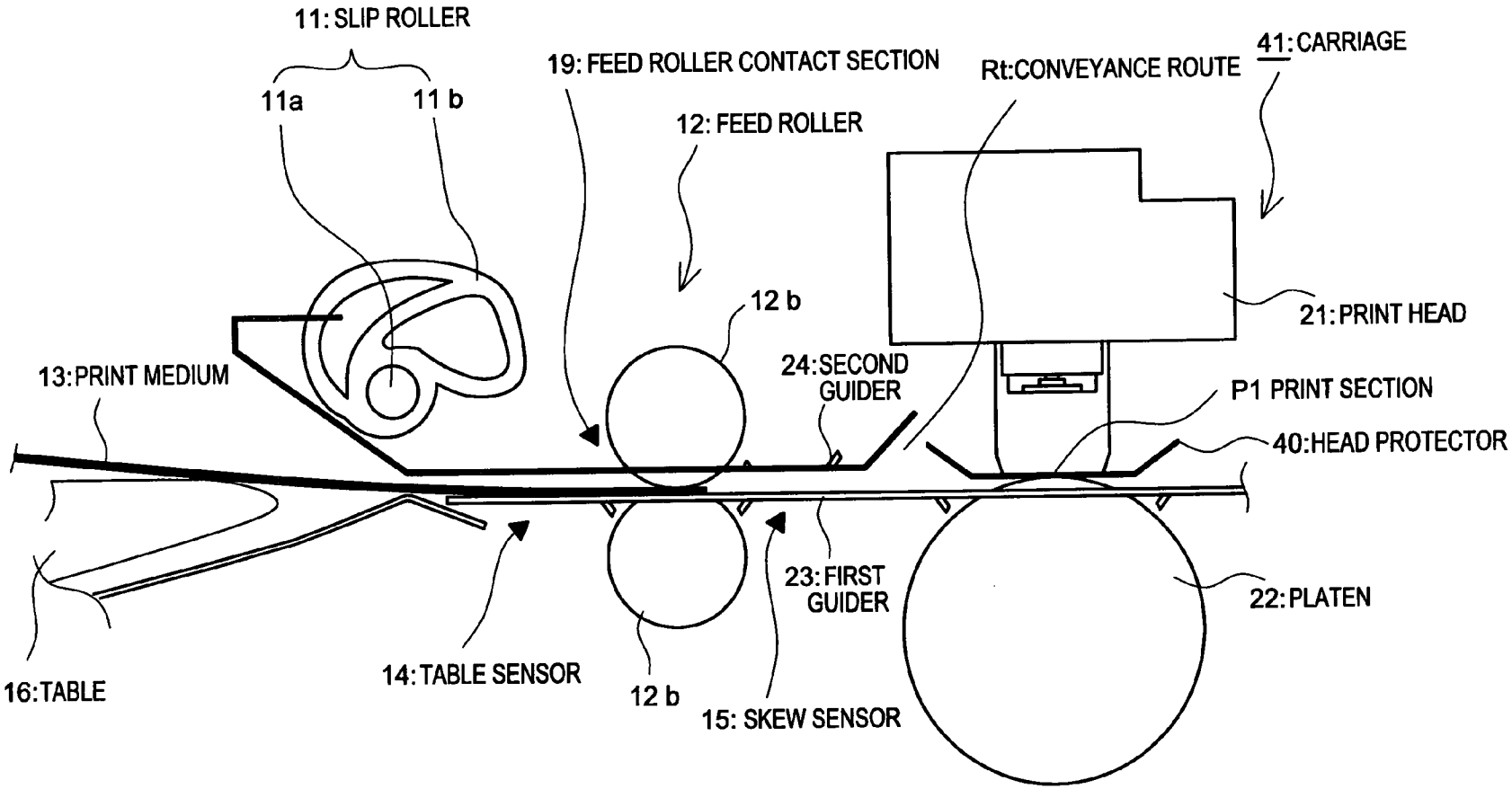
FIG. 20 is a summary structure diagram showing a conventional printing apparatus.
Figure 21:
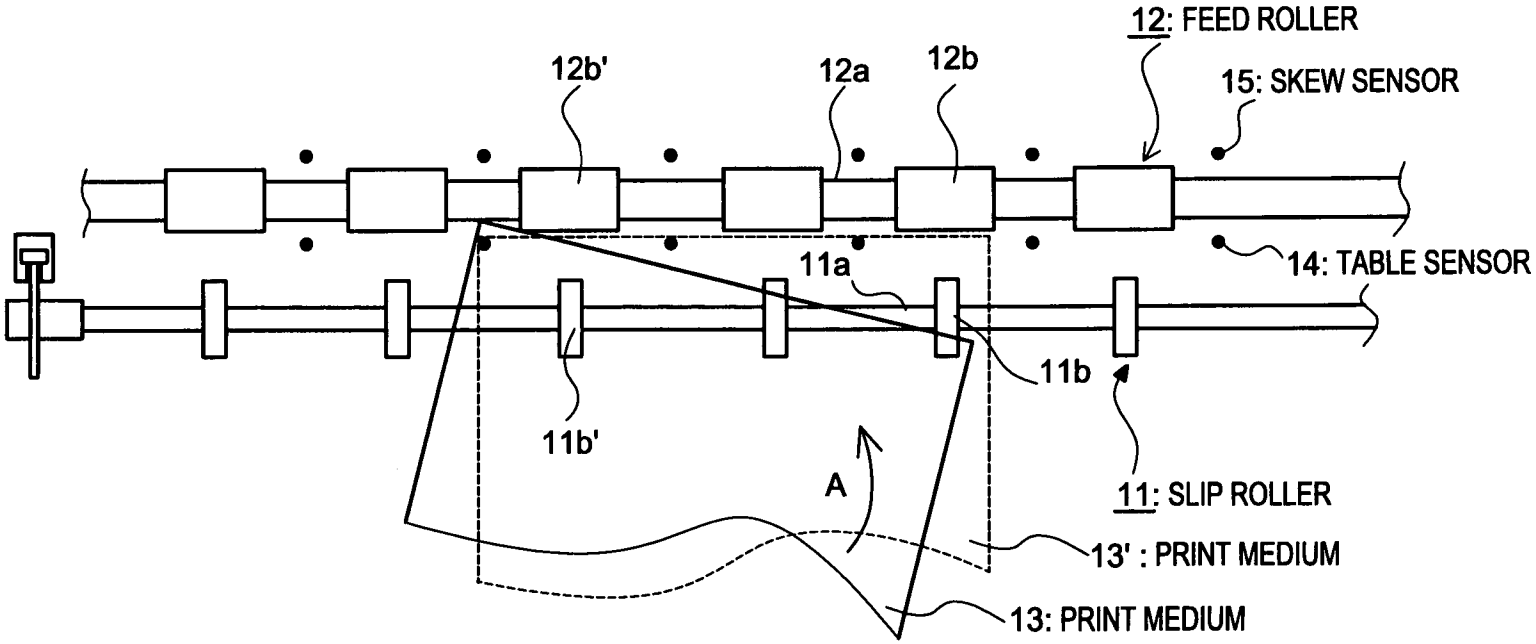
FIG. 21 is an operation flowchart of a conventional printing apparatus.

FIG. 19A is a control flowchart of a printing apparatus in embodiment 4 (1); and FIG. 19B is a control flowchart of a printing apparatus in embodiment 4 (2).

According to the above structure, the printing apparatus of the embodiment 4 performs the following operations. The operations are explained by using the control flowchart of the FIG. 19. Moreover, regarding the steps S1-S8, because they are the same as that in embodiment 1, their detail explanations are omitted. Regarding the case that in the step S8, the sheet supply of the print medium 13 ends, and the process enters step S61, it will be explained.

First is to judge whether a difference of respective inclination counts of the skew sensor 39*a* and the skew sensor 39*b* in step S7 exceeds a threshold value (Step S61). The threshold value in the case is a table value shown by FIG. 17, for example, when the table sensor number is 3, because the skew judgment standard value is 7/360 inch+predetermined margin, so the threshold value is set to 7/360 inch+predetermined margin for judging.

In the case that the difference exceeds the threshold value and it is judged that there is a skew, the process enters step S75 and output the print medium 13, then executes a retrying operation from skew rectification operation in step S3 till three times, if the skew can not be rectified, a warning including skew state contents is displayed (Step S76).

On the other hand, in the case that the skew quantity is judged being less than the threshold value, next is to judge whether the skew quantity is 0 or not (Step S62). If the skew quantity is 0, the process enters step S77 to detect the print medium width.

That is, in order to execute detection operation of the print medium width using the skew sensor 39*a* and the skew sensor 39*b*, the skew sensor 39*a* is moved to a position which is over and faces to a left sensor at the left hand of the most left edge sensor in which the table sensor 14 detected the print medium exists. In the case that there is not a sensor on the outside of the most left edge sensor in which the table sensor 14 detected the print medium exists, the head protector is moved to a most left edge position in a movable range (Step S77).

Next is to detect the print medium width while moving the head protector 40 to the right. That is, the skew sensor 39*a* recognizes the position in which firstly detected that the print medium 13 exists to serve as a print medium left edge position; and the skew sensor 39*b* recognizes the position in which finally detected that the print medium 13 is existing then un-existing to serve as a print medium right edge position (Step S78).

Then is to move the head protector 40 so as to make the skew sensor 39*b* to place at a position which is over and faces to a right sensor at the right hand of the most right edge sensor in which the table sensor 14 detected the print medium exists. In the case that there is not a sensor on the outside of the most right edge sensor in which the table sensor 14 detected the print medium exists, the head protector is moved to a most right edge position in a movable range (Step S79).

Further, in the case that the skew quantity is not 0 in step S62, the inclination count quantity (Y1 value) from the upper edge detected by the skew sensor 39*a* in step S7 is retained (Step S63).

Then, in order to execute detection operation of the print medium width using the skew sensor 39*a* and the skew sensor 39*b*, the skew sensor 39*a* is moved to a position which is over and faces to a left sensor at the left hand of the most left edge sensor in which the table sensor 14 detected the print medium exists. In the case that there is not a sensor on the outside of the most left edge sensor in which the table sensor 14 detected the print medium exists, the head protector is moved to a most left edge position in a movable range (Step S64).

Next is to detect the print medium width while moving the head protector 40 to the right. That is, the skew sensor 39*a* recognizes the position in which firstly detected that the print medium 13 exists to serve as a print medium left edge position; and the skew sensor 39*b* recognizes the position in which finally detected that the print medium 13 is existing then un-existing to serve as a print medium right edge position (Step S65).

Then is to move the head protector 40 so as to make the skew sensor 39*b* to place at a position which is over and faces to a right sensor at the right hand of the most right edge sensor in which the table sensor 14 detected the print medium exists. In the case that there is not a sensor on the outside of the most right edge sensor in which the table sensor 14 detected the print medium exists, the head protector is moved to a most right edge position in a movable range (Step S66).

Then is to move the head protector 40 to the print medium right edge position, in order to make the skew sensor 39*b* can certainly detect the upper edge of the4 print medium 13, the skew sensor 39*b* is placed at the inside of the print medium 13 with respect to the print medium right edge position (Step S67).

Next is to execute a contrary feed operation by a feed quantity part (Step S68). The feed quantity L1 at that time is a quantity from a current position to a position of the skew sensor 39*a*+α part, that is, a quantity of L1 part till a position in which the tip of the print medium does not come off the feed roller is moved. Then is to execute a positive feed operation, and to convey the print medium 13 toward the printing section P1 (Step S69).

Further is to start to update an inclination count at a timing when the skew sensor 39*b* detected the upper edge, and to update the line feed motor (not shown) per one pulse (for example, 1/360 inch) (Step S50. Furthermore, the set line feed quantity (L1) negatively updates the line feed motor (not shown) per one pulse (for example, 1/360 inch) (Step S70).

Then is to judge whether the line feed quantity (in the case: L1 part) till ending the sheet supply ended (Step S71). When the line feed quantity becomes 0, the line feed is ended, the process enters step S72.

That is, through requesting a inclination count difference between the inclination count of the skew sensor 39*a* in first sheet supply and the inclination count of the skew sensor 39*b* in second sheet supply, a skew quantity is detected (Step S72).

Next is to convert a skew judgment threshold value based on the measured skew sensor width and the print medium width (Step S73). That is, the width between the skew sensor 39*a* used in first sheet supply and the skew sensor 39*b* used in second sheet supply serves as the measured skew sensor width. Then, in the case that the skew standard value is 1 mm, the skew judgment threshold value is obtained through the following calculation.

$$\text{Threshold value}=(\text{skew sensor width}/\text{print medium width})\times 1\ \text{mm}(\text{standard value}) \quad (1)$$

Then is to execute a comparison of the threshold value and the skew quantity (Step S74). When the threshold exceeds the skew quantity, it is judged that there is a skew state, and to discharge the print medium 13 (Step S75). Then in the case that a retrying operation from skew rectification operation in step S3 is executed till three times and the skew can not be rectified, a warning including skew state contents is displayed (Step S76). On the other hand, when the skew quantity is less than the threshold value, the supplying operation is ended.

Effect of Embodiment 4

As the above stated detail explanation, according to the printing apparatus of the embodiment 4, on the basis of the measured skew sensor width obtained by measure skew quantity and print medium width, a skew judgment threshold value is obtained, then on the basis of the skew judgment threshold value, a skew judgment is executed, therefore, it is possible to further certainly detect the skew.

The present invention can be applied to printing apparatus, copying apparatus or the like which conveys medium possible having skew and executes predetermined process.

The present invention is not limited to the foregoing embodiments but many modifications and variations are possible within the spirit and scope of the appended claims of the invention.

What is claimed is:

1. A sheet supplying unit comprising:

a conveying section configured to convey a sheet in a sheet conveyance direction;

a plurality of first detecting sections configured to detect the sheet supplied to a surface of the conveying section, the plurality of first detecting sections being arranged in a spaced relation in a detection direction substantially perpendicular to the sheet conveyance direction;

a moving body placed at a downstream side of said sheet conveyance direction and being movable;

a pair of second detecting sections placed on said moving body in the detection direction with an interval and being configured to detect said sheet; and a controlling section configured, when the set of first detecting sections detect the existence of the sheet, to control a movement the moving body to place one of the pair of second detecting sections within a width region of the sheet, and to move the sheet along a first direction to a width detection position for detecting a width of the sheet using the second detection sections, wherein, when the sheet passes only one of the second detecting sections during the movement of the sheet to the width detection position along the first direction, the controlling section moves the moving body to place the other of the second detecting sections within the width region of the sheet, moves the sheet along a second direction opposite to the first direction from the width detection position, and further along the first direction to the width detection position, and judges the skew of the sheet in accordance with a first skew value corresponding to when the sheet passes only one of the second detecting sections and a second skew value corresponding to when the sheet further passes the other of the second detecting sections.

2. The sheet supplying unit according to claim 1, wherein said moving body carries a machinery to execute print on said sheet.

3. The sheet supplying unit of claim 1, wherein the controlling section counts a line feed quantity between a start time when one of the second detecting sections detects an upper edge of the sheet and an end time when the one of the second detecting sections detects a lower edge of the sheet, and compares the line feed quantity to a skew judgment threshold to decide whether the sheet has an excess skew.

4. The sheet supplying unit of claim 3, wherein the convey section is configured to discharge the sheet if the sheet has the excess skew.

5. The sheet supplying unit of claim 1, further comprising a skew rectifying section configured to rectify an initial skew of the sheet using a detection result of the first detecting sections, so that the second detecting sections detect the sheet after the skew rectifying section rectifies the initial skew of the sheet.

6. The sheet supplying unit of claim 1, wherein the controlling section judges whether or not the sheet passes only one of the second detecting sections during the movement of the sheet to the width detection position along the first direction according to a number of times the set of the first detecting sections detect the existence of the sheet.

7. The sheet supplying unit of claim 6, wherein the controlling section controls, when the set of the first detecting sections detects the existence of the sheet a number N times and N is larger than a first threshold N1, to judge the skew of the sheet according to the first and second skew values respectively corresponding to when the sheet passes the one and the other of the second detecting sections along the first direction.

8. The sheet supplying unit of claim 6, wherein, when the set of the first detecting sections detects the existence of the sheet a number N times and N is between a first threshold N1 and a second threshold N2 smaller than N1, and when the second detecting sections are not placed within the sheet with a predetermined margin during skew detection, the controlling section controls the second detecting sections to move to within the sheet, and to further execute the skew detection.

* * * * *